US010762836B1

(12) United States Patent
Bae et al.

(10) Patent No.: US 10,762,836 B1
(45) Date of Patent: Sep. 1, 2020

(54) ELECTRONIC DISPLAY EMISSION SCANNING USING ROW DRIVERS AND MICRODRIVERS

(71) Applicant: Apple Inc., Cupertino, CA (US)

(72) Inventors: Hopil Bae, Sunnyvale, CA (US); Wei H. Yao, Palo Alto, CA (US); Mohammad B. Vahid Far, San Jose, CA (US); Yafei Bi, Palo Alto, CA (US); Xiaofeng Wang, San Jose, CA (US); Thomas Charisoulis, Mountain View, CA (US); Hasan Akyol, Mountain View, CA (US); Henry C. Jen, Los Altos, CA (US); Derek K. Shaeffer, Redwood City, CA (US)

(73) Assignee: Apple Inc., Cupertino, CA (US)

( * ) Notice: Subject to any disclaimer, the term of this patent is extended or adjusted under 35 U.S.C. 154(b) by 270 days.

(21) Appl. No.: 15/275,023

(22) Filed: Sep. 23, 2016

Related U.S. Application Data

(60) Provisional application No. 62/297,108, filed on Feb. 18, 2016.

(51) Int. Cl.
*G09G 3/3233* (2016.01)

(52) U.S. Cl.
CPC ... *G09G 3/3233* (2013.01); *G09G 2300/0404* (2013.01); *G09G 2310/08* (2013.01)

(58) Field of Classification Search
CPC ..... G09G 3/20; G09G 3/2074; G09G 3/2092; G09G 3/2096; G09G 3/30; G09G 3/32; G09G 3/3216; G09G 3/3233; G09G 3/3241; G09G 3/3258; G09G 3/3266; G09G 3/3275; G09G 3/3283; G09G 3/3291; G09G 2300/0452; G09G 2300/0404; G09G 2300/0465; G09G 2300/06; G09G 2310/0221; G09G 2310/0267; G09G 2310/0272; G09G 2310/0281; G09G 2310/0286; G09G 2310/0294; G09G 2310/08; G09G 2320/0223; G09G 2320/0233; G09G 2320/041; G09G 2320/045; G09G 2330/08; G09G 2330/10; H01L 27/3211; H01L 27/3223; H01L 27/3241; H01L 27/3244; H01L 27/3255; H01L 27/3281; H01L 27/3288; H01L 27/3293; H01L 27/3297; H05B 33/0806
See application file for complete search history.

(56) References Cited

U.S. PATENT DOCUMENTS 5,827,753 A * 10/1998 Huang ..... H01L 27/156 438/24
9,047,818 B1 * 6/2015 Day ..... G09G 3/3233
2006/0160255 A1 * 7/2006 Chang ..... G09G 3/3258 438/14
2007/0085779 A1 * 4/2007 Smith ..... G09G 3/3216 345/76
2007/0205968 A1 * 9/2007 Chen ..... G09G 3/2003 345/76

(Continued)

*Primary Examiner* — Keith L Crawley
(74) *Attorney, Agent, or Firm* — Fletcher Yoder P.C.

(57) ABSTRACT

An electronic display row drivers or column drivers that send reference currents or voltages to microdrivers to be used to drive micropixels to particular levels. The microdrivers, in turn, ship current to micropixels that display images based at least in part on the shipped current.

23 Claims, 24 Drawing Sheets

(56) References Cited

U.S. PATENT DOCUMENTS

| | | | | |
|---|---|---|---|---|
| 2010/0265224 | A1* | 10/2010 | Cok | G09G 3/3266 345/206 |
| 2014/0104243 | A1* | 4/2014 | Sakariya | G06F 3/14 345/204 |
| 2014/0168037 | A1* | 6/2014 | Sakariya | G09G 3/3216 345/82 |
| 2014/0368561 | A1* | 12/2014 | Liao | G09G 3/2014 345/692 |
| 2017/0061842 | A1* | 3/2017 | Cok | G09G 3/2003 |
| 2017/0187976 | A1* | 6/2017 | Cok | H04N 5/376 |
| 2018/0247586 | A1* | 8/2018 | Vahid Far | G09G 3/2003 |

* cited by examiner

ELECTRONIC DISPLAY EMISSION SCANNING USING ROW DRIVERS AND MICRODRIVERS

CROSS REFERENCE TO RELATED APPLICATION

This application claims priority from and the benefit of U.S. Provisional Application Ser. No. 62/297,108, filed Feb. 18, 2016 entitled "Electronic Display", and is incorporated by reference herein in its entirety.

BACKGROUND

The present disclosure relates generally to techniques for driving a display and, more particularly, to techniques for driving of the electronic display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic display uniformity is a valuable factor to ensure images are displayed on a display properly. Uniformity may be decreased by fluctuations based on temperature, threshold voltage variations, voltage drop due to electrical resistance in the display (IR drop), or supply variation. Specifically, IR drop in the panel can impact the overdrive voltage of the current source inside and cause brightness errors and display artifacts. Severity of the artifacts is display pattern dependent, and the problem may worsen as more pixels serially share a current or voltage supply. In other words, more pixels sharing a current or voltage supply may increase the IR drop to cause non-uniformity of the display and/or artifacts, which degrade display quality.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Row drivers and column drivers may be used to provide driving signals for micropixels to microdrivers that then distribute the driving signals to the micropixels connected to the microdrivers. Micropixels may include any display pixels that are driven by a microdriver. For example, a pixel may be a unit of a display that includes a single color (e.g., red, green, white, or blue) or a pixel may be a unit of sub-pixels of single individual colors with the pixel capable of displaying any color that the display is capable of achieving due to combinations of the individual colors.

The row and column drivers, in combination with the microdrivers, enable the display to accurately pinpoint individual micropixels and/or sub-pixels or groups of pixels and/or sub-pixels that are to be driven. However, as the communications extend further from the drivers, voltage may drop due to electrical resistance in the display. In this disclosure, this drop in voltage is referred to as IR drop. IR drop may be compensated for by shipping current to the micropixels by generating a current in the microdrivers, in the row drivers, in the column drivers, a timing controller, or other suitable circuitry prior to shipment to the micropixels.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
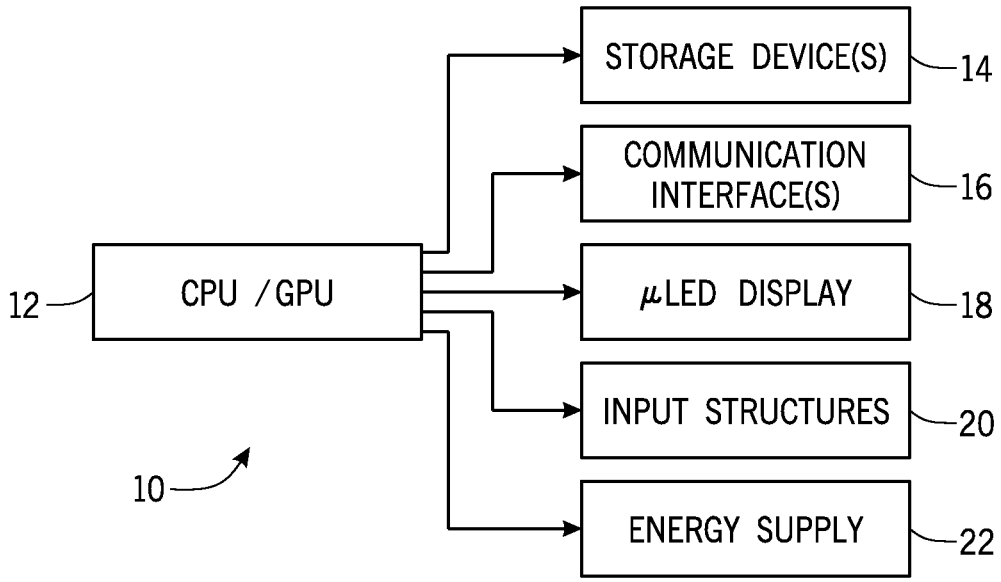
FIG. 1 is a block diagram of components of an electronic device that may include a micro light emitting diode (μ-LED) display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed above, IR drop is a voltage drop due to an internal resistance of an electronic display that may cause display artifacts on the electronic display. The IR drop may refer to an analog IR drop or a digital IR drop. Analog IR drop is at a low frequency due to the current through the passing through the micro light emitting diodes. Digital IR drop refers to an IR drop caused by digital switching (e.g., emission scanning).

Suitable electronic devices that may include a micro-LED (μ-LED) display and corresponding circuitry of this disclosure are discussed below with reference to FIGS. 1-4. The LEDs may include light emitting diodes, organic light emitting diodes, or any other suitable light emitting circuitry. One example of a suitable electronic device 10 may include, among other things, processor(s) such as a central processing unit (CPU) and/or graphics processing unit (GPU) 12, storage device(s) 14, communication interface(s) 16, a μ-LED display 18, input structures 20, and an energy supply 22. The blocks shown in FIG. 1 may each represent hardware, software, or a combination of both hardware and software. The electronic device 10 may include more or fewer components. It should be appreciated that FIG. 1 merely provides one example of a particular implementation of the electronic device 10.

The CPU/GPU 12 of the electronic device 10 may perform various data processing operations, including generating and/or processing image data for display on the display 18, in combination with the storage device(s) 14. For example, instructions that can be executed by the CPU/GPU 12 may be stored on the storage device(s) 14. The storage device(s) 14 thus may represent any suitable tangible, computer-readable media. The storage device(s) 14 may be volatile and/or non-volatile. By way of example, the storage device(s) 14 may include random-access memory, read-only memory, flash memory, a hard drive, and so forth.

The electronic device 10 may use the communication interface(s) 16 to communicate with various other electronic devices or components. The communication interface(s) 16 may include input/output (I/O) interfaces and/or network interfaces. Such network interfaces may include those for a personal area network (PAN) such as Bluetooth, a local area network (LAN) or wireless local area network (WLAN) such as Wi-Fi, and/or for a wide area network (WAN) such as a long-term evolution (LTE) cellular network.

Using pixels containing an arrangement of μ-LEDs, the display 18 may display images generated by the CPU/GPU 12. The display 18 may include touchscreen functionality to allow users to interact with a user interface appearing on the display 18. Input structures 20 may also allow a user to interact with the electronic device 10. For instance, the input structures 20 may represent hardware buttons. The energy supply 22 may include any suitable source of energy for the electronic device. This may include a battery within the electronic device 10 and/or a power conversion device to accept alternating current (AC) power from a power outlet.

Figure 2:
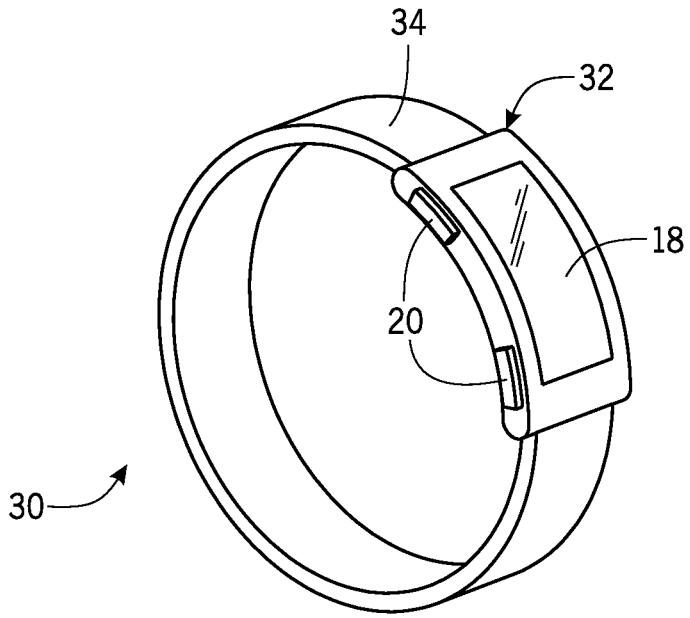
FIG. 2 is a perspective view of the electronic device in the form of a fitness band, in accordance with an embodiment.
Figure 3:
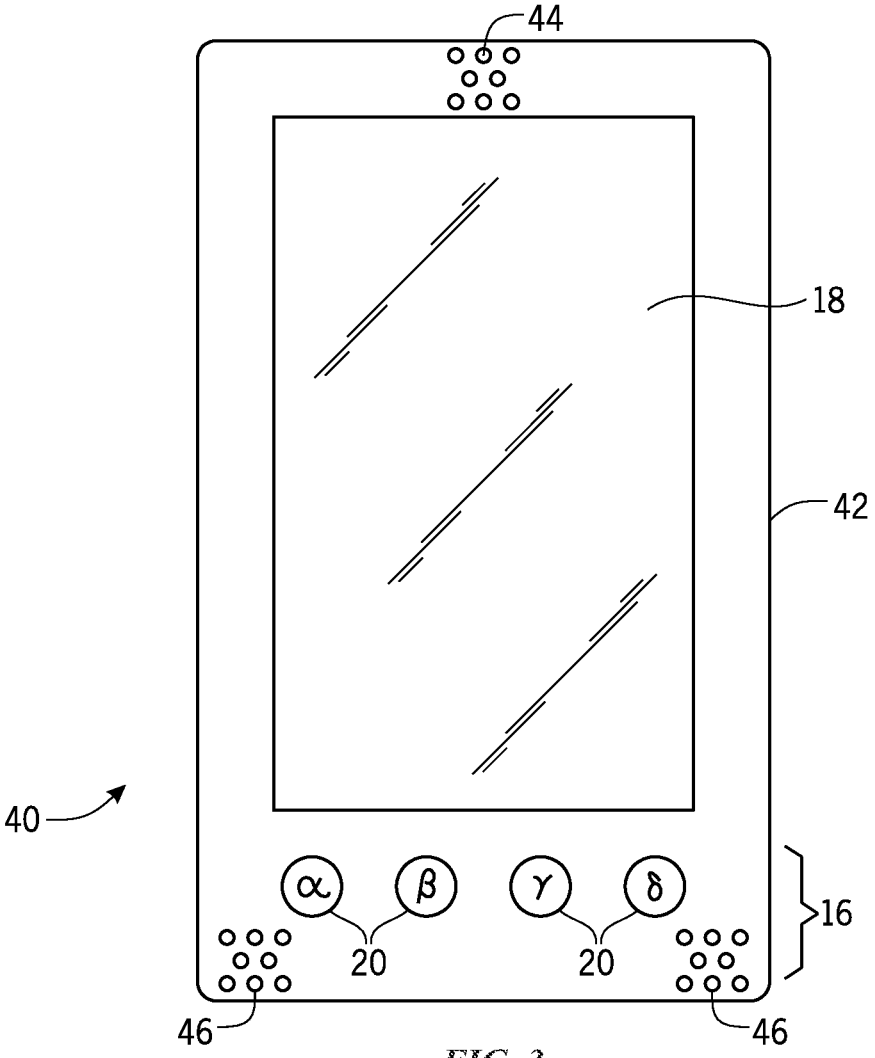
FIG. 3 is a front view of the electronic device in the form of a slate, in accordance with an embodiment.
Figure 4:
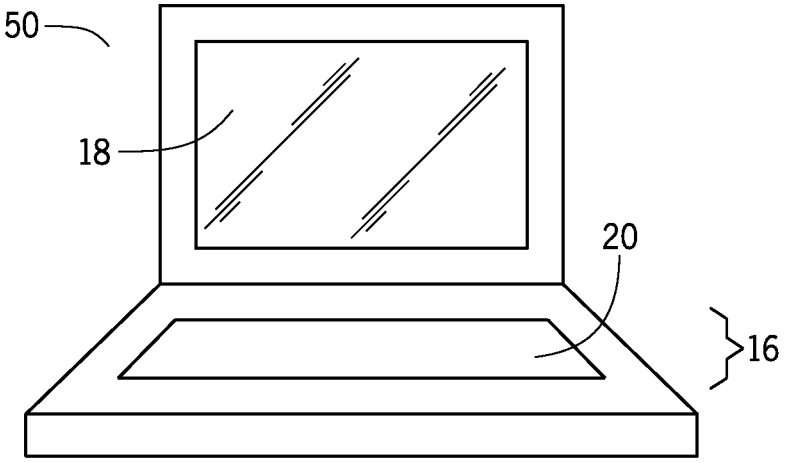
FIG. 4 is a perspective view of the electronic device in the form of a notebook computer, in accordance with an embodiment.

As may be appreciated, the electronic device 10 may take a number of different forms. As shown in FIG. 2, the electronic device 10 may take the form of a fitness band 30. The fitness band 30 may include an enclosure 32 that houses the electronic device 10 components of the fitness band 30. A strap may allow the fitness band 30 to be worn on the arm or wrist. The display 18 may display information related to the fitness band operation. Additionally or alternatively, the fitness band 30 may operate as a watch, in which case the display 18 may display the time. Input structures 20 may allow a person wearing the fitness band 30 navigate a graphical user interface (GUI) on the display 18.

The electronic device 10 may also take the form of a slate 40. Depending on the size of the slate 40, the slate 40 may serve as a handheld device such as a mobile phone. The slate 40 includes an enclosure 42 through which several input structures 20 may protrude. The enclosure 42 also holds the display 18. The input structures 20 may allow a user to interact with a GUI of the slate 40. For example, the input structures 20 may enable a user to make a telephone call. A speaker 44 may output a received audio signal and a microphone 46 may capture the voice of the user. The slate 40 may also include a communication interface 16 to allow the slate 40 to connect via a wired connection to another electronic device.

A notebook computer 50 represents another form that the electronic device 10 may take. It should be appreciated that the electronic device 10 may also take the form of any other computer, including a desktop computer. The notebook computer 50 shown in FIG. 4 includes the display 18 and input structures 20 that include a keyboard and a track pad. Communication interfaces 16 of the notebook computer 50 may include, for example, a universal service bus (USB) connection.

Figure 5:
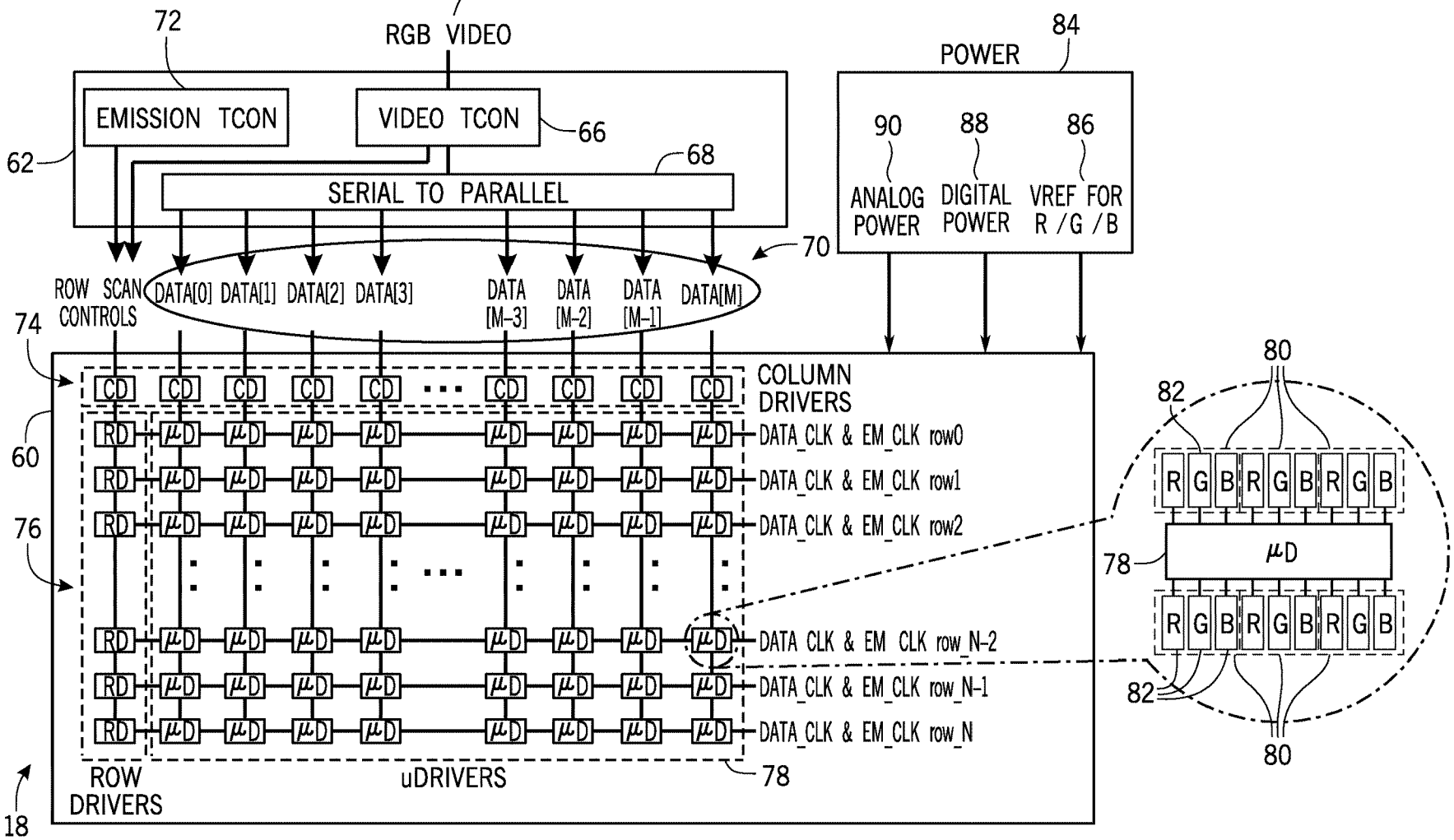
FIG. 5 is a block diagram of μ-LED display that employs micro-drivers (μDs) to drive μ-LED sub-pixels with control signals from row drivers (RDs) and data signals from column drivers (CDs), in accordance with an embodiment.

A block diagram of the architecture of the μ-LED display 18 appears in FIG. 5. In the example of FIG. 5, the display 18 uses an RGB display panel 60 with pixels that include red, green, and blue μ-LEDs as subpixels. Support circuitry 62 thus may receive RGB-format video image data 64. It should be appreciated, however, that the display 18 may alternatively display other formats of image data, in which case the support circuitry 62 may receive image data of such different image format. In the support circuitry 62, a video timing controller (TCON) 66 may receive and use the image data 64 in a serial signal to determine a data clock signal (DATA_CLK) to control the provision of the image data 64 in the display 18. The video TCON 66 also passes the image data 64 to serial-to-parallel circuitry 68 that may deserialize the image data 64 signal into several parallel image data signals 70. That is, the serial-to-parallel circuitry 68 may collect the image data 64 into the particular data signals 70 that are passed on to specific columns among a total of M respective columns in the display panel 60. As such, the data 70 is labeled DATA[0], DATA[1], DATA[2], DATA[3] . . . DATA[M−3], DATA[M−2], DATA[M−1], and DATA[M]. The data 70 respectively contain image data corresponding to pixels in the first column, second column, third column, fourth column . . . fourth-to-last column, third-to-last column, second-to-last column, and last column, respectively. The data 70 may be collected into more or fewer columns depending on the number of columns that make up the display panel 60.

As noted above, the video TCON 66 may generate the data clock signal (DATA_CLK). An emission timing controller (TCON) 72 may generate an emission clock signal (EM_CLK). Collectively, these may be referred to as Row Scan Control signals, as illustrated in FIG. 5. These Row Scan Control signals may be used by circuitry on the display panel 60 to display the image data 70.

In particular, the display panel 60 includes column drivers (CDs) 74, row drivers (RDs) 76, and micro-drivers (μDs) 78. Each μD 78 drives a number of pixels 80 having μ-LEDs as subpixels 82. Each pixel 80 includes at least one red μ-LED, at least one green μ-LED, and at least one blue μ-LED to represent the image data 64 in RGB format. Although the μDs 78 of FIG. 5 is shown to drive six pixels 80 having three subpixels 82 each, each μD 78 may drive more or fewer pixels 80. For example, each μD 78 may respectively drive 1, 2, 3, 4, 5, 6, 7, 8, 9, 10, 11, 12, or more pixels 80.

A power supply 84 may provide a reference voltage ($V_{ref}$) 86 to drive the μ-LEDs, a digital power signal 88, and an analog power signal 90. In some cases, the power supply 84 may provide more than one reference voltage ($V_{ref}$) 86 signal. Namely, subpixels 82 of different colors may be driven using different reference voltages. As such, the power supply 84 may provide more than one reference voltage ($V_{ref}$) 86. Additionally or alternatively, other circuitry on the display panel 60 may step the reference voltage ($V_{ref}$) 86 up or down to obtain different reference voltages to drive different colors of μ-LED.

To allow the μDs 78 to drive the μ-LED subpixels 82 of the pixels 80, the column drivers (CDs) 74 and the row drivers (RDs) 76 may operate in concert. Each column driver (CD) 74 may drive the respective image data 70 signal for that column in a digital form. Meanwhile, each RD 76 may provide the data clock signal (DATA_CLK) and the emission clock signal (EM_CLK) at an appropriate to activate the row of μDs 78 driven by the RD 76. A row of μDs 78 may be activated when the RD 76 that controls that row sends the data clock signal (DATA_CLK). This may cause the now-activated μDs 78 of that row to receive and store the digital image data 70 signal that is driven by the column drivers (CDs) 74. The μDs 78 of that row then may drive the pixels 80 based on the stored digital image data 70 signal based on the emission clock signal (EM_CLK).

Figure 6:
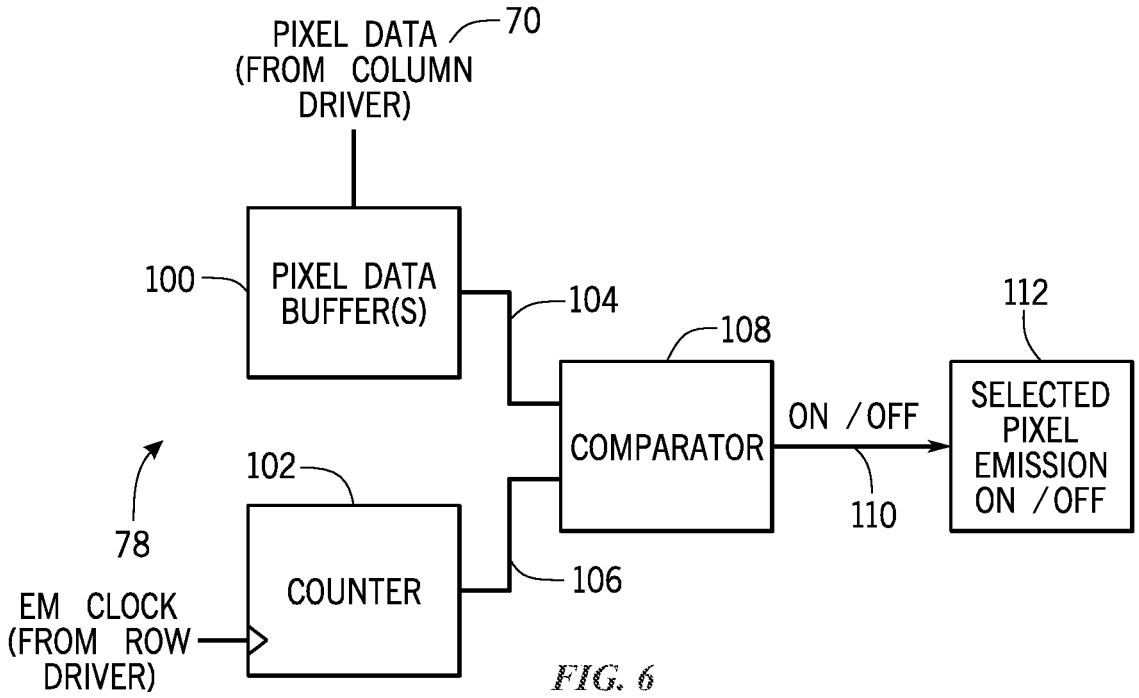
FIG. 6 is a block diagram schematically illustrating an operation of one of the micro-drivers (μDs), in accordance with an embodiment.

A block diagram shown in FIG. 6 illustrates some of the components of one of the μDs 78. The μD 78 shown in FIG. 6 includes pixel data buffer(s) 100 and a digital counter 102. The pixel data buffer(s) 100 may include sufficient storage to hold the image data 70 that is provided. For instance, the μD 78 may include pixel data buffers to store image data 70 for three subpixels 82 at any one time (e.g., for 8-bit image data 70, this may be 24 bits of storage). It should be appreciated, however, that the μD 78 may include more or fewer buffers, depending on the data rate of the image data 70 and the number of subpixels 82 included in the image data 70. The pixel data buffer(s) 100 may take any suitable logical structure based on the order that the column driver (CD) 74 provides the image data 70. For example, the pixel data buffer(s) 100 may include a first-in-first-out (FIFO) logical structure or a last-in-first-out (LIFO) structure.

When the pixel data buffer(s) 100 has received and stored the image data 70, the RD 76 may provide the emission clock signal (EM_CLK). A counter 102 may receive the emission clock signal (EM_CLK) as an input. The pixel data buffer(s) 100 may output enough of the stored image data 70 to output a digital data signal 104 represent a desired gray level for a particular subpixel 82 that is to be driven by the μD 78. The counter 102 may also output a digital counter signal 106 indicative of the number of edges (only rising, only falling, or both rising and falling edges) of the emission clock signal (EM_CLK) 98. The signals 104 and 106 may enter a comparator 108 that outputs an emission control signal 110 in an "on" state when the signal 106 does not exceed the signal 104, and an "off" state otherwise. The emission control signal 110 may be routed to driving circuitry (not shown) for the subpixel 82 being driven, which may cause light emission 112 from the selected subpixel 82 to be on or off. The longer the selected subpixel 82 is driven "on" by the emission control signal 110, the greater the amount of light that will be perceived by the human eye as originating from the subpixel 82.

Figure 7:
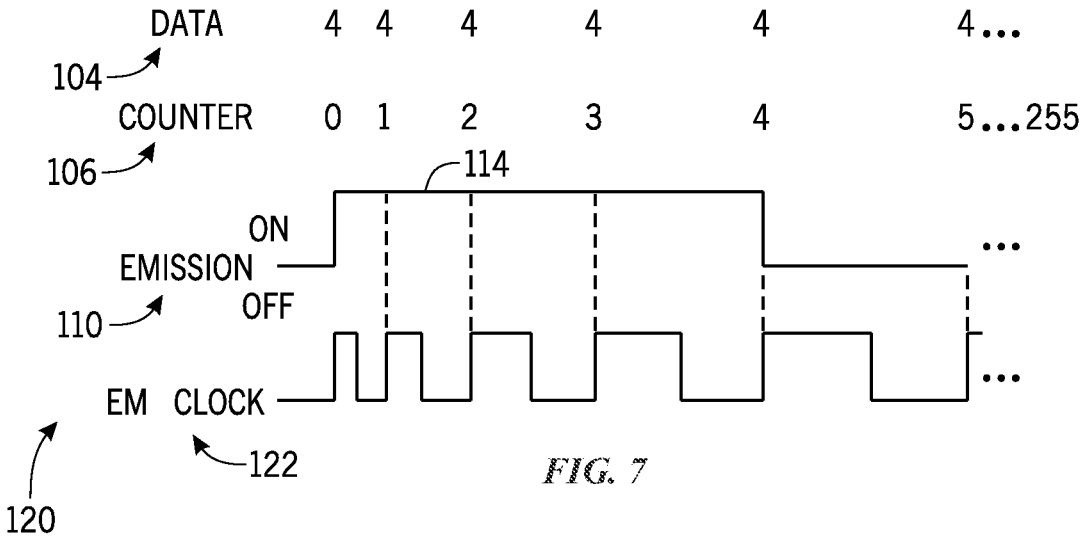
FIG. 7 is a timing diagram illustrating an example operation of the micro-driver (μD) of FIG. 6, in accordance with an embodiment.

A timing diagram 120, shown in FIG. 7, provides one brief example of the operation of the μD 78. The timing diagram 120 shows the digital data signal 104, the digital counter signal 106, the emission control signal 110, and the emission clock signal (EM_CLK) represented by numeral 122. In the example of FIG. 7, the gray level for driving the selected subpixel 82 is gray level 4, and this is reflected in the digital data signal 104. The emission control signal 110 drives the subpixel 82 "on" for a period of time defined as gray level 4 based on the emission clock signal (EM_CLK). Namely, as the emission clock signal (EM_CLK) rises and falls, the digital counter signal 106 gradually increases. The comparator 108 outputs the emission control signal 110 to an "on" state as long as the digital counter signal 106 remains less than the data signal 104. When the digital counter signal 106 reaches the data signal 104, the comparator 108 outputs the emission control signal 110 to an "off" state, thereby causing the selected subpixel 82 no longer to emit light.

It should be noted that the steps between gray levels are shown by the steps between emission clock signal (EM_CLK) edges. That is, based on the way humans perceive light, to notice the difference between lower gray levels, the difference between the amount of light emitted between two lower gray levels may be relatively small. To notice the difference between higher gray levels, however, the difference between the amounts of light emitted between two higher gray levels may be comparatively much greater. The emission clock signal (EM_CLK) therefore may use relatively short time intervals between clock edges at first. To account for the increase in the difference between light emitted as gray levels increase, the differences between edges (e.g., periods) of the emission clock signal (EM_CLK) may gradually lengthen. The particular pattern of the emission clock signal (EM_CLK), as generated by the emission TCON 72, may have increasingly longer differences between edges (e.g., periods) so as to provide a gamma encoding of the gray level of the subpixel 82 being driven.

Displays may use PMOS or NMOS LED drivers that do not use huge level shifters. In some embodiments, these drivers are driven and/or drive using specific voltage levels (e.g., voltage driven). However, some LED drivers (e.g., PMOS drivers) are sensitive to threshold voltage variation of one or more transistors in the driver varying a voltage used to drive the transistor to a different state. Temperature and oxide thickness each have an effect on the threshold voltage some transistor types (e.g., CMOS device).

Specifically, with temperature, the surface potential has a direct relationship with the temperature. While the threshold voltage may not have a direct relationship to temperature and some other effects, the threshold voltage is not independent of these effects. For example, a change of 30° C. results in significant variation from the 500 mV design parameter (e.g., $V_{TH}$) commonly used for a 90 nm technology node.

Impurity concentrations may also effect different threshold voltages across different portions of a display. For example, random dopant fluctuation (RDF) is a form of process variation resulting from variation in the implanted impurity concentration. In MOSFET transistors, RDF in the channel region can alter the transistor's properties, especially threshold voltage. As the number of dopants decreases, such as in modem dopings, the effects of RDF can be greater.

Figure 8:
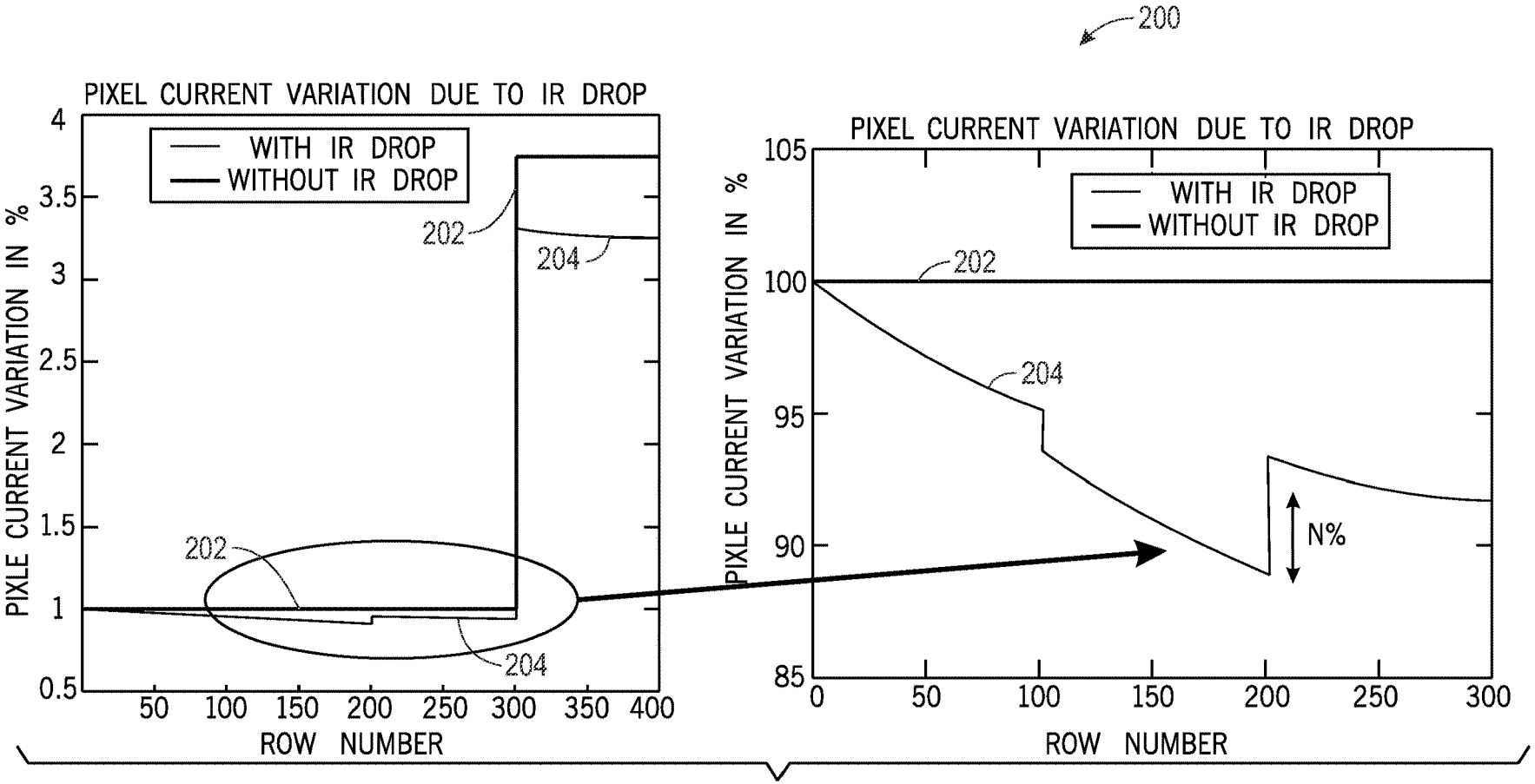
FIG. 8 illustrates plots of variation due to IR drop in the drive current supplied to the subpixels, in accordance with an embodiment.

Pixels may also vary based on voltage fluctuations of supplied power (e.g., Vdd). These voltages may vary due to IR drop as well as other voltage fluctuation effects. For example, FIG. 8 illustrates a pixel current variation graph 200 that illustrates a pixel current variation due to IR drop. A first line 202 illustrates an ideal pixel current, but the second line 204 illustrates a pixel current variation due to IR drop. For example, the IR drop may result from Vdd variation due to resistance or other electronic properties of components (e.g., trace length) from the Vdd source to the pixel. IR drop may effect any voltage transmitted to the pixel. As illustrated, the IR drop causes the pixel current to deviate from the ideal value of the first line 202 to the second line 204. Furthermore, the IR drop may vary from pixel-to-pixel since different electrical components may exist between some pixels and the voltage sources than for other pixels. In other words, pixels further from the edges of a display experience more IR drop.

The micropixels (e.g., sub-pixels) may be driven using a voltage mode or a current mode. For example, a voltage mode may include row drivers providing a reference voltage to microdrivers for each pixel with the microdrivers forwarding the reference voltage to the micropixels. Additionally or alternatively, the current mode may include row drivers providing a reference current (e.g., at a constant voltage) to the microdrivers to the micropixels, a timing controller providing a reference current to the row drivers, row drivers receiving the reference voltage from the timing controller and locally generating the reference current, column drivers providing the reference current to the microdrivers to the micropixels, and/or other suitable pathways for sending a reference current to the micropixels.

Voltage Mode

Various components of the electronic device 10 may be used to control the current signal supplied to drive LED devices 208 of the pt-LED display 18. The LED devices 208 may include micropixels/subpixels/pixels of the display 18. For example, as will be further appreciated, the μDs 78 may include a p-type metal-oxide-semiconductor (PMOS) device, an n-type metal-oxide-semiconductor (NMOS) device, or some combination of PMOS and NMOS devices.

In certain embodiments, the number of LED devices 208A may each be coupled to a high voltage potential rail (e.g., "$V_{DD}$") and a low voltage potential rail or ground (e.g., "$V_{SS}$" or "GND"). For example, the high voltage potential rail (e.g., "$V_{DD}$") may be set to a voltage of 1.2V, 1.5V, 1.8V, 2.5V, 3.3V, 5V, or other similar voltage that may be used to supply power to the subpixels 82 for operation. Similarly, the low voltage potential rail or ground (e.g., "$V_{SS}$" or "GND") 212A may be generally set to a ground voltage (e.g., 0V or approximately 0V).

In some embodiments, the μDs 78 may each include a PMOS driver used to drive the Subpixels 82. For example, PMOS drivers may be used as part of the μDs 78 in order to conserve physical area of the μ-LED display 18 by avoiding level shifters that may be otherwise involved. However, in some embodiments, utilizing PMOS drivers as part of the μDs 78 may lead to image artifacts (e.g., flicker) becoming present on the μ-LED display 18, as the PMOS drivers may be sensitive to variations of the high voltage potential rail (e.g., "$V_{DD}$") 210A. The variations of the high voltage potential rail (e.g., "$V_{DD}$") 210A may be caused by IR drop (e.g., voltage drops across the resistance R of the power supply 198A between supply pins and one or more components drawing a current I). As noted above, FIG. 8 illustrates graph 200 illustrating variation of the drive current supplied to the subpixels (e.g., "ILED") due to IR drop. As illustrated, the IR drop may cause the drive current (e.g., "ILED") of the subpixels 82 to vary by N % (e.g. 5-10% or otherwise significantly enough for the variation to appear as visible artifacts to a user of the μ-LED display 18).

Indeed, the $V_{DD}$ variations may vary depending on the incoming image data and the image pattern, as the luminance of the μ-LED display 18 and the characteristics of the subpixels 82 may also be variable. Furthermore, variations in the threshold voltage (e.g., "$V_{TH}$") of the subpixels 82 may also adversely impact the drive currents (e.g., "ILED") of the subpixels 82. As may be further appreciated, the $V_{DD}$ and $V_{TH}$ variations may be exacerbated for larger area μ-LED displays 18. Thus, as will be further appreciated with respect to FIGS. 9-20, it may be useful to provide $V_{DD}$ and $V_{TH}$ compensation circuitry 205 as part of the μDs 78 to compensate for the aforementioned $V_{DD}$ and $V_{TH}$ adverse variations. In this way, any possible occurrence of image artifacts becoming apparent on the μ-LED display 18 may be reduced or substantially eliminated.

Figure 9:
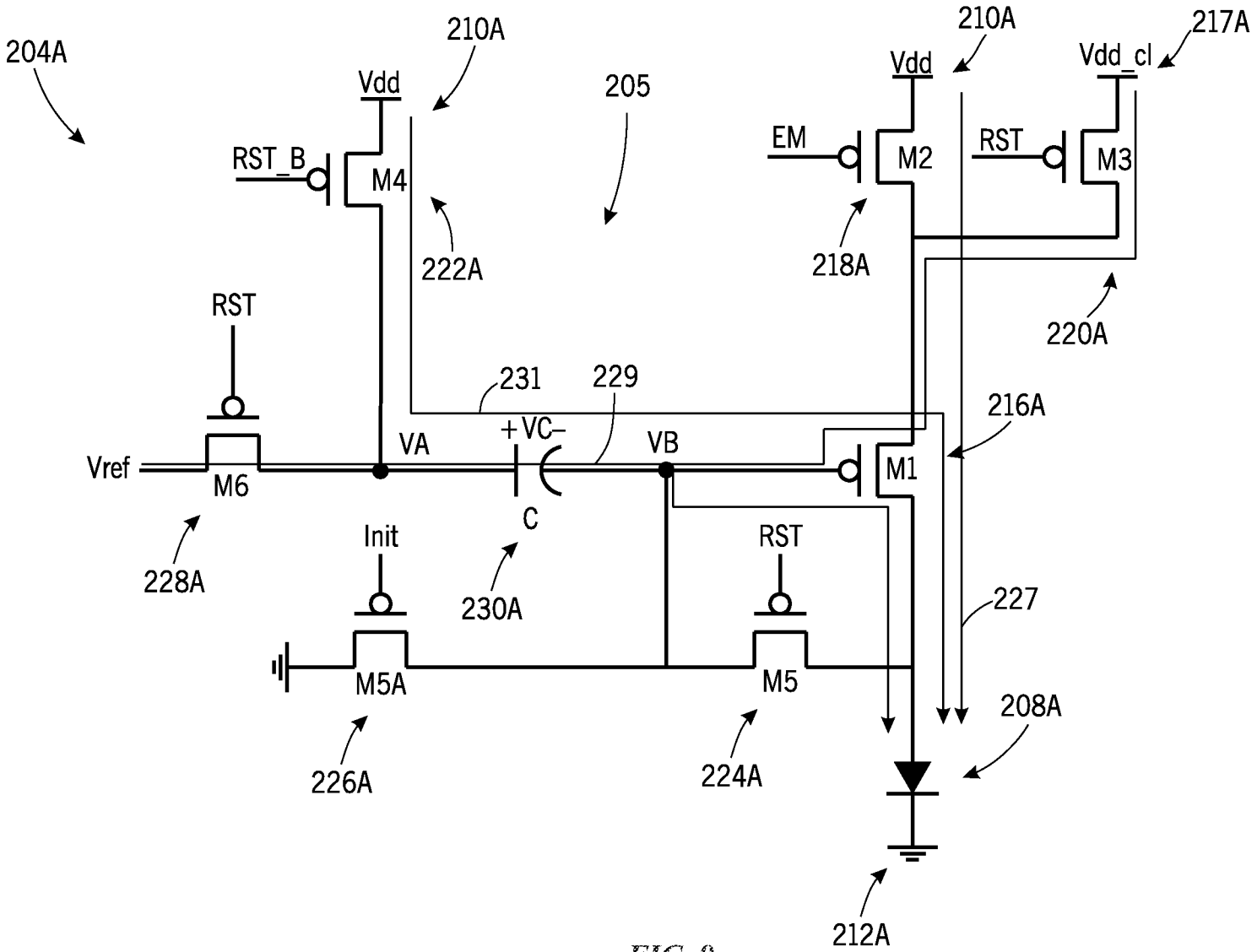
FIG. 9 is a circuit diagram (e.g., equivalent circuit) of one example of the μDs including VDD and $V_{TH}$ compensation circuitry, in accordance with an embodiment.

Turning now to FIG. 9, which illustrates an embodiment of a circuit diagram (e.g., equivalent circuit) of the μDs 78 including $V_{DD}$ and $V_{TH}$ compensation circuitry 205 that may be used to compensate for the $V_{DD}$ and $V_{TH}$ variations that may be due to, for example, IR drop (e.g., voltage drops across the resistance R of the power supply 198A between supply pins and one or more components drawing a current I) associated the high voltage potential rail (e.g., "$V_{DD}$") 210A. In certain embodiments, the μDs 78 may be set to operate over one or more phases of the drive currents (e.g., "ILED") of the subpixels 82.

For example, in an initial phase (e.g., "Phase 1"), the voltage VB may be low (e.g., approximately "GND" or 0V). Thus, a PMOS transistor 216A (e.g., "M5") coupled (e.g., in series) between a PMOS transistor 218A (e.g., "M5A") and the high voltage potential rail (e.g., "$V_{DD}$") 210A coupled directly to the high voltage potential rail (e.g., "$V_{DD}$") 210A may be "ON" (e.g., activated). The PMOS transistor 218A may also be "ON," as the voltage EM may also be low (e.g., approximately "GND" or 0V) in the initial phase (e.g., "Phase 1"). Accordingly, a drive current may be allowed to flow from the high voltage potential rail (e.g., "$V_{DD}$") 210A to the LED device 208A. In some embodiments, the PMOS transistor 216A may be susceptible to $V_{DD}$ voltage variations, while the PMOS transistor 218A may be susceptible to $V_{TH}$ voltage variations.

In certain embodiments, in a reset phase 229 (e.g., "Phase 2"), the voltage EM may be low (e.g., approximately "GND" or 0V), while the voltages VA and VB may be expressed as:

$$VA=V_{Ref} \quad \text{(Equation 1);}$$

$$VB=V_{DD_CL}-V_{TH} \quad \text{(Equation 2).}$$

Specifically, $V_{Ref}$ may be the reference supply voltage for the LED device 208A that may be controlled by the PMOS 228A. $V_{DD_CL}$ may be an additional high voltage potential rail (e.g., "$V_{DD_CL}$") 217A (e.g., independent of the high voltage potential rail ("$V_{DD}$") 210A). Thus, in the reset phase (e.g., "Phase 2"), when $V_A=V_{Ref}$ and $V_B=V_{DD_CL}$ $V_{TH}$, the following condition may exist:

$$VB=V_{DD_CL}-V_{TH}, \text{ for } VB<V_{TH_LED} \quad \text{(Equation 3).}$$

In this case, the LED device 208A may not turn "ON." Furthermore, in the reset phase (e.g., "Phase 2"), the voltage VC (e.g., voltage across a compensation capacitance 230A) may be expressed as:

$$VC=V_{Ref}-V_{DD_CL}-V_{TH} \quad \text{(Equation 4).}$$

As may be appreciated from the foregoing equation, the voltage VC may be a voltage across a compensation capacitance 230A that may, in some embodiments, be the difference between the reference voltage $V_{Ref}$ and the voltage VB.

In certain embodiments, in another reset phase 231 (e.g., "Phase 3"), the voltages VA and VB may be then expressed as:

$$VA=V_{DD} \quad \text{(Equation 5);}$$

$$VB=VA-VC \quad \text{(Equation 6).}$$

Expanding equations (5) and (6) based on equations (1), (2), and (4), the voltage VB may be then expressed as:

$$VB=V_{DD}-V_{Ref}+V_{DD_CL}-V_{TH} \quad \text{(Equation 7).}$$

Thus, when $VB<V_{DD}-V_{TH}$ and $V_{TH}<V_{DD_CL}<V_{Ref}$, the PMOS transistor 216A (e.g., "M1"), the PMOS transistor 216A (e.g., "M5"), and the PMOS transistor 228A (e.g., "M6") may each be "ON" (e.g., conductive or in the saturation mode). Indeed, further, when $V_{Ref}<V_{TH}<V_{TH\ Diode}$, the LED device 208A drive current $I_{LED}$ may be expressed as:

$$I_{LED}=K(V_{GS}-V_{TH})^2=K(V_{DD}-VB-V_{TH})^2 \quad \text{(Equation 8).}$$

Expanding equation 8 based on equation 7, the LED device 208A drive current $I_{LED}$ may be then expressed as:

$$I_{LED}=K(V_{DD}-(V_{DD}-V_{Ref}+V_{DD_CL}-V_{TH})-V_{TH})^2 \quad \text{(Equation 9).}$$

Lastly, simplifying equation 9, the LED device 208A drive current $I_{LED}$ may be expressed as:

$$I_{LED}=K(V_{Ref}+V_{DD_CL})^2 \quad \text{(Equation 10).}$$

Accordingly, equation 10 illustrates that LED device 208A drive current $I_{LED}$ may be independent of the high voltage potential rail (e.g., $V_{DD}$) and the threshold voltage (e.g., $V_{TH}$), and may thus compensate for $V_{DD}$ and $V_{TH}$ variations that may otherwise adversely affect drive current $I_{LED}$ (e.g., due to IR drop). Indeed, instead of being a function of $V_{DD}$ and $V_{TH}$ (e.g., as expressed by equation (8)) and, by extension, being susceptible to $V_{DD}$ and $V_{TH}$ variations (e.g., due to IR drop), the LED device 208A drive current $I_{LED}$ may be function of the μDs 78 reference voltage $V_{Ref}$ and the compensation voltage potential rail $V_{DD_CL}$. In this way, any possible occurrence of image artifacts becoming apparent on the μ-LED display 18 may be reduced or substantially eliminated.

Figure 10:
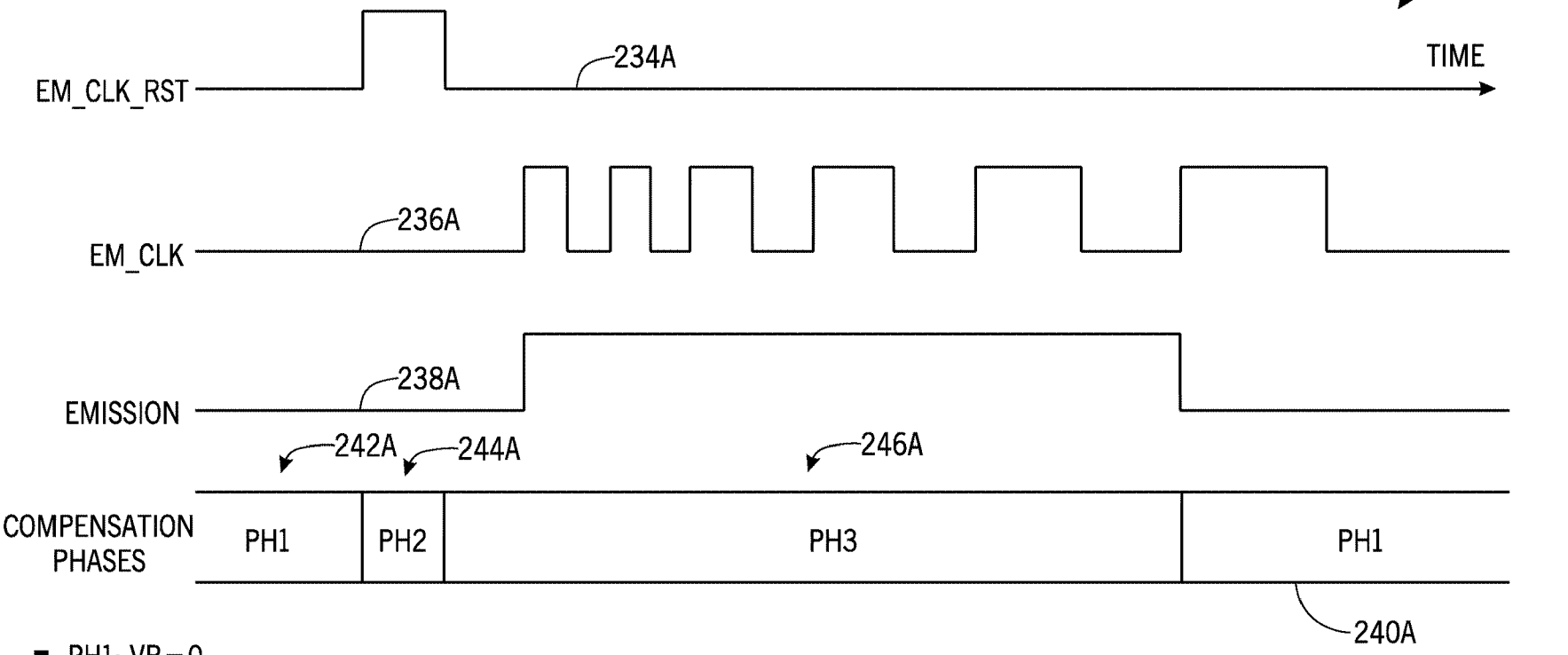
FIG. 10 is a timing diagram, which depicts VDD and $V_{TH}$ compensation phases (e.g., "PH1," "PH2," and "PH3"), in accordance with an embodiment.

As a further example of the presently disclosed embodiments, FIG. 10 illustrates a timing diagram 232A, which depicts each of the aforementioned $V_{DD}$ and $V_{TH}$ compensation phases (e.g., "PH1," "PH2," and "PH3"). Specifically, FIG. 10 illustrates an emission clock reset signal 234A (e.g., "EM_CLK_RST"), the LED device 208A drive current signal 236A (e.g., "EM_CLK"), LED device 208A emission signal 238A (e.g., "Emission"), and compensation phases timing signal 240A. As depicted in FIG. 10, during phase 1 (e.g., "PH1"), VB=0. During phase 2 (e.g., 229, "PH2"), corresponding to a period of time in which the μD 78 generates the emission clock reset signal 234A (e.g., "EM_CLK_RST"), $VA=V_{Ref}$ and $VB=V_{DD_CL}$ $V_{TH}$. In certain embodiments, during phase 3 (e.g., "PH3"), $VA=V_{DD}$ and $VB=V_{DD}-V_{Ref}+V_{DD_CL}-V_{TH}$. As illustrated, during phase 3 (e.g., "PH3"), the LED device 208A drive current signal 236A (e.g., "EM_CLK") may be activated, in which over the period of phase 3 (e.g., 231, "PH3") the duty cycle of the pulses of the of drive current signal 236A (e.g., "EM_CLK") may vary (e.g., corresponding to a period in which the LED device 208A is emitting as illustrated by the emission signal 238A) based on, for example, the incoming image data and the image pattern.

Figure 11:
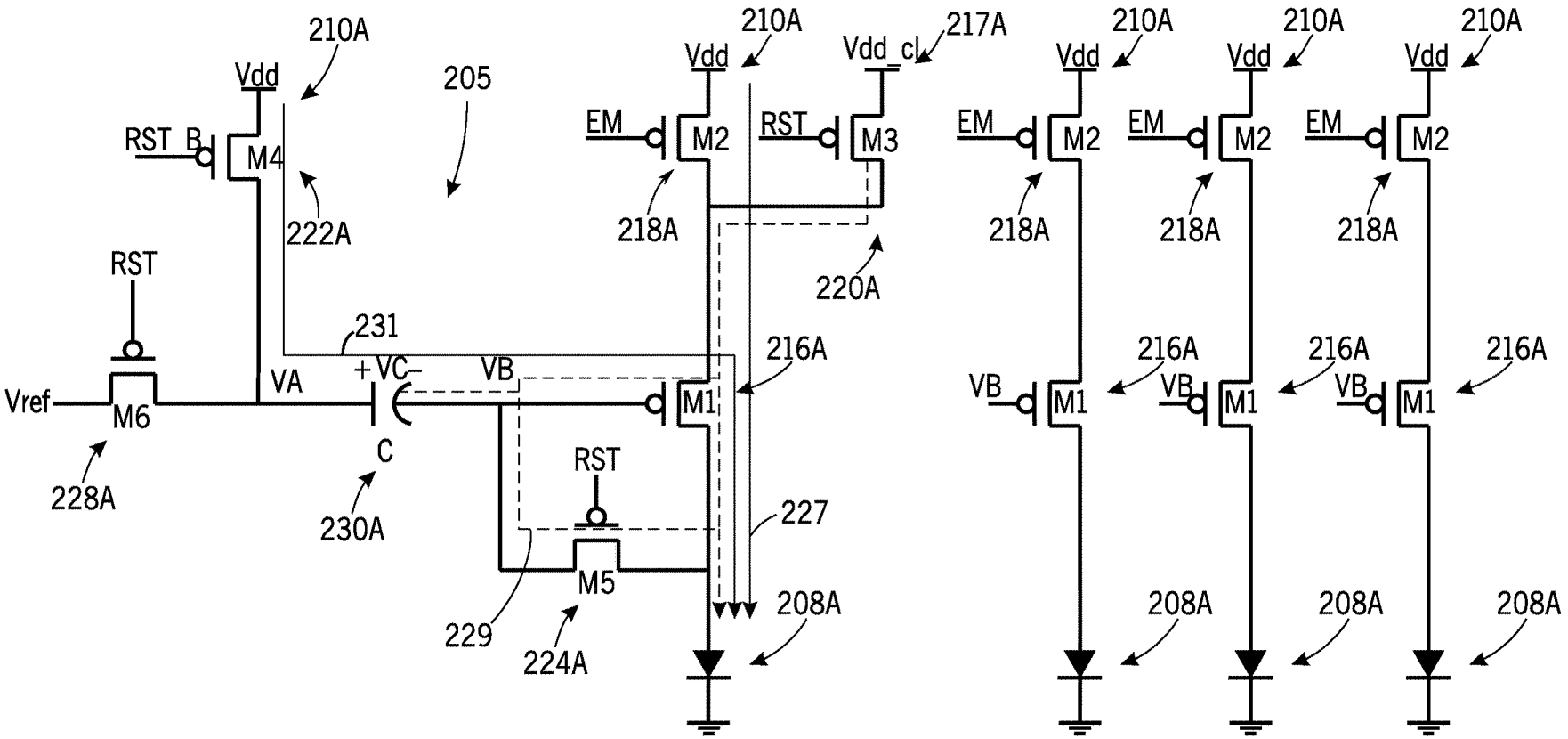
FIG. 11 is a circuit diagram (e.g., equivalent circuit) of another example of the μDs including VDD and $V_{TH}$ compensation circuitry, in accordance with an embodiment.

Turning now to FIG. 11, which illustrates an embodiment of a circuit diagram (e.g., equivalent circuit) of the μDs 78 including $V_{DD}$ and $V_{TH}$ compensation circuitry 205 that may be used to compensate for the $V_{DD}$ and $V_{TH}$ variations that may be due to, for example, IR drop associated the high voltage potential rail (e.g., "$V_{DD}$") 210A. Specifically, FIG. 11 illustrates that the $V_{DD}$ and $V_{TH}$ compensation is shared between all LED device 208A with the same color (e.g., for each respective R, G, and B LED device 208A). For example, the μD 78 may provide $V_{DD}$ and $V_{TH}$ compensation for each color red LED device 208A of the μ-LED display 18, green LED device 208A of the μ-LED display 18, and blue LED device 208A of the μ-LED display 18.

Current Mode

In the current mode, pixel data is displayed relative to a reference current, IREF. The reference current causes the pixel performance to be independent of VDD and ground variations thereby reducing the IR drop effect on pixel performance. In some embodiments, a timing controller 72 passes a reference current to row drivers that is then passed further down. Alternatively, the IREF may be generated by a respective row driver 76 and passed to the μD 78. In some embodiments, $V_{ref}$ may be passed all the way to the microdriver and locally converted to a current to be passed to the micropixels.

Figure 12A:
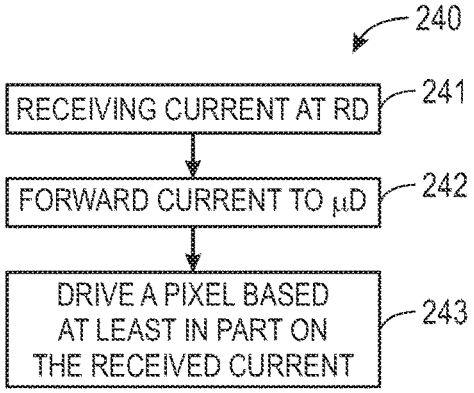
FIG. 12A is a flowchart of a process for driving a display using current shipped to a row driver, in accordance with an embodiment.

FIG. 12A illustrates a flowchart diagram of a process 240 for driving pixels using a reference current. Receiving a reference current at a row driver 76 (block 241). Forwarding the reference current from the row driver 76 to one or more μD 78 (block 242). Driving one or more pixels using the μD 78 based at least in part on the reference current (block 243).

Figure 12B:
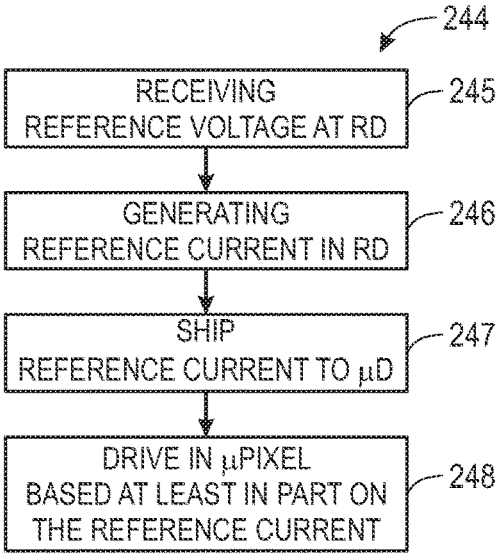
FIG. 12B is a flowchart of a process for driving a display using a reference voltage shipped to a row driver, in accordance with an embodiment.

FIG. 12B illustrates a flowchart diagram of a process 244 for driving pixels using a reference voltage that is converted to a current prior to transmission to the micropixels. A row driver receives a reference voltage (block 245). For example, the row driver may receive the voltage from a timing controller or another suitable electronic component. The row driver generates a reference current based at least in part on the reference voltage (block 246). The local generation includes various compensation, as will be discussed below. For example, by locating the row drivers near an edge of a panel, IR drop may be less drastic than shipping voltage further along the display (e.g., to microdrivers via the row drivers). Furthermore, the local generation circuitry may include compensation circuitry that compensates for threshold voltages of transistors and/or temperature fluctuations of the electronic components.

Once the current has been generated, the row driver ships the current to a microdriver (block 247). The microdrivers then drive micropixels using a selective current mirror or other suitable circuitry (block 248). Moreover, although the foregoing discussion relates to row driver current generation, some embodiments may include column driver current generation and shipping the current to the microdrivers using the column drivers.

Figure 12C:
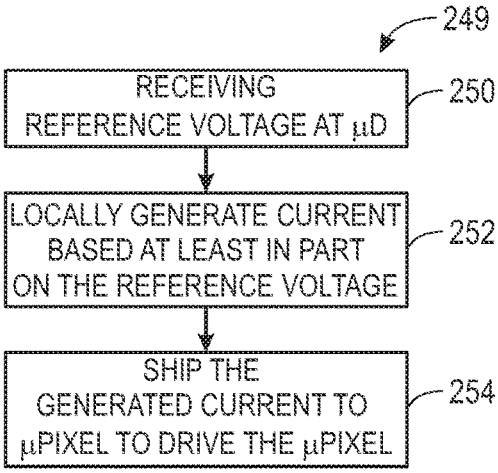
FIG. 12C is a flowchart of a process for driving a display using a reference voltage shipped to a microdriver, in accordance with an embodiment.

FIG. 12C illustrates a flow chart diagram of a process 249 for operating a display. The process 249 includes receiving a reference voltage at a microdriver (block 250). The microdriver may receive a clean supply voltages (e.g., VDD ground) that have been cleaned for transmission to the microdriver. The microdriver generates a current based at least in part on the reference voltage received (block 252). The local generation of current may be similar to the local generation conducted in the row driver discussed above and below. The microdriver ships the generated current to micropixels to drive the micropixels of the display panel (block 254).

Figure 13:
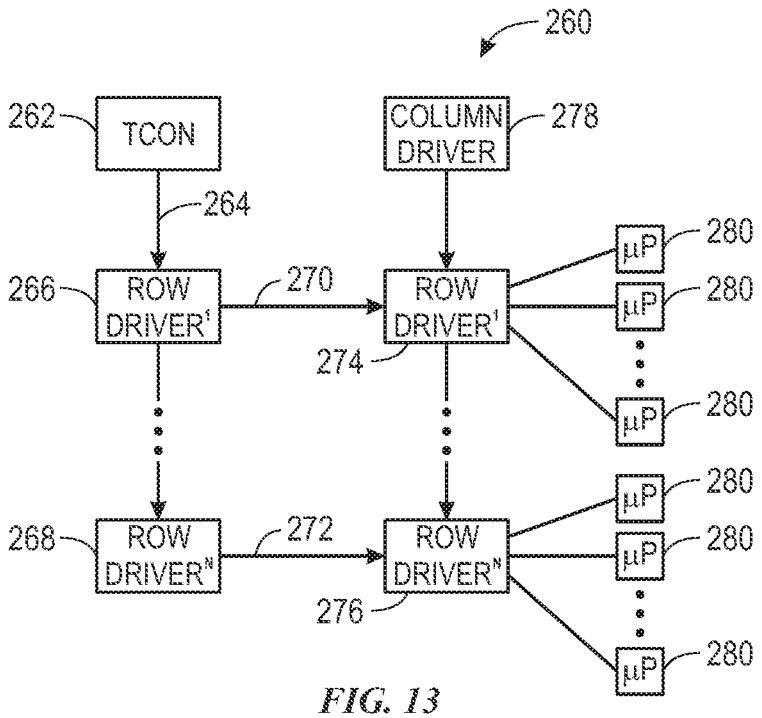
FIG. 13 is a block diagram of a portion of the display that may be driven according to the processes of FIG. 12A, 12B, or 12C, in accordance with an embodiment.

For example, FIG. 13 illustrates a schematic view of a display 260. A timing controller 262 sends a reference current 264 (or voltage) to multiple row drivers 266, 268. For example, the display 260 may include a number of row drivers proportional to the number of rows in the display. For instance, the row drivers 266, 268 may drive a one, two, three, four, or more rows such that the number of row drivers is equal to the number of rows divided by the number of rows driven by each row driver. The row drivers 266, 268 send current or voltage references 270, 272 to the μDs 266, 268. For example, the TCON 262 may send a global reference current that is locally converted for each row within a respective row driver, such as row driver 266. If the microdriver receives a reference voltage, the microdriver generates a reference current from the reference voltage for transmission to the micropixels 280 coupled to the microdriver. Since, the reference current is less susceptible to IR drop than reference voltage applications less mura effects may appear on the display.

Figure 14:
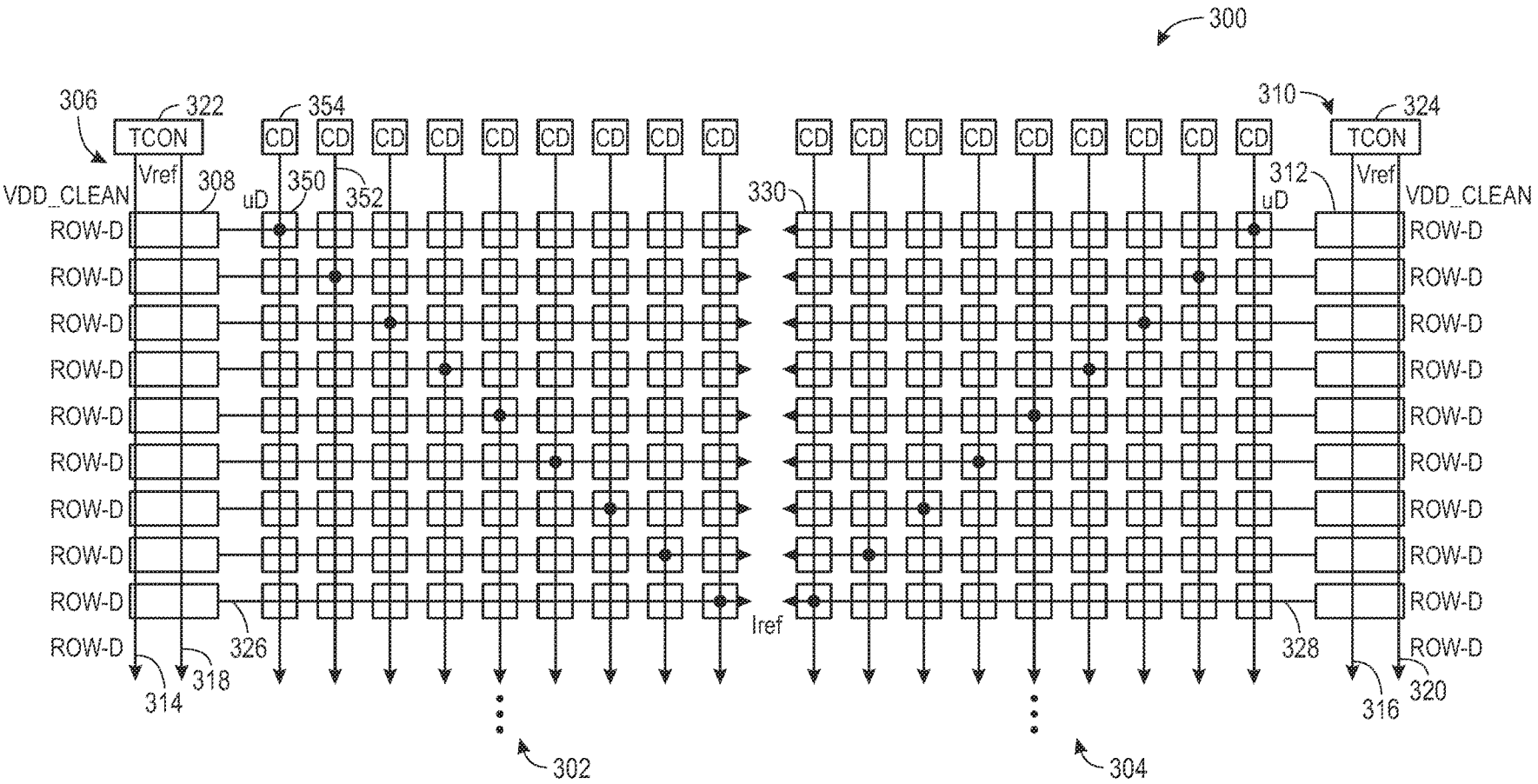
FIG. 14 is a schematic view of a display panel driven using voltage supplied to row drivers, in accordance with an embodiment.

FIG. 14 illustrates a portion of a display 300. The display 300 includes segments 302 and 304 corresponding to two horizontal halves of the display that are driven by a first column 306 of row drivers 308 and a second column 310 of row drivers 312. Since the first column 306 and the second column 310 are located at the edge of the display, it is easier to provide clean power (e.g., $V_{DD}$ and GND) and a $V_{ref}$ to the row drivers. In the illustrated embodiment, the row drivers 308, 312 are provided a clean $V_{DD}$ 314 and 318, respectively. The row drivers 308, 312 also receive a $V_{ref}$ 316 and 320, respectively. In some embodiments, the first column 308 receives the clean $V_{DD}$ 314 and $V_{ref}$ 316 from a timing controller 322, and the second column 310 receives $V_{DD}$ 318 and $V_{ref}$ 320 from a timing controller 324. The row drivers 308 receive the $V_{ref}$ 316 or 320 and generate a reference current 326 or 328, respectively. In other words, in the illustrated embodiment, $V_{ref}$ is shipped as a global signal to the row drivers 308, and the row drivers convert the $V_{ref}$ to an $I_{ref}$ and use pixel compensation to set the current level. The current is then shipped to the microdrivers.

By shipping the current horizontally, the TCON 322, 324 can be used with adding pins for each row. Furthermore, each row provides a current for a section of a column of microdrivers 330. For example, the number of rows driven in a section may be determined by number of columns in the display. For example, the illustrated embodiment includes 9 columns in a segment and thus 9 rows in a section. However, these numbers may vary by the number of microdrivers of the display. For example, the display may have 10, 20, 30, 39, 50, or more columns and rows of microdrivers in a segment. Within a segment, each row driver provides current for the portion of the column in the segment. For example, in the illustrated embodiment, the first column of microdrivers 350 in a segment is driven by the first row driver 308 and so on. Alternatively, the pattern for each row driver shipping current to each column in the segment.

By segmenting the columns into segments, the panel is segmented with reduced parasitic capacitance for each line. Thus, for each segment, the current is time-multiplexed for the number of micropixels in a column/line. Thus, if the segment has 39 microdrivers per column/line in a segment, each line is loaded with 1/20th of the line driving time. However, each segment is independent from other segments, but thus, even with time-multiplexing, timing requirements may be relaxed from a single segment display. Also, these currents may be provided through column lines 352 that are used to drive data using column drivers 354.

Figure 15:
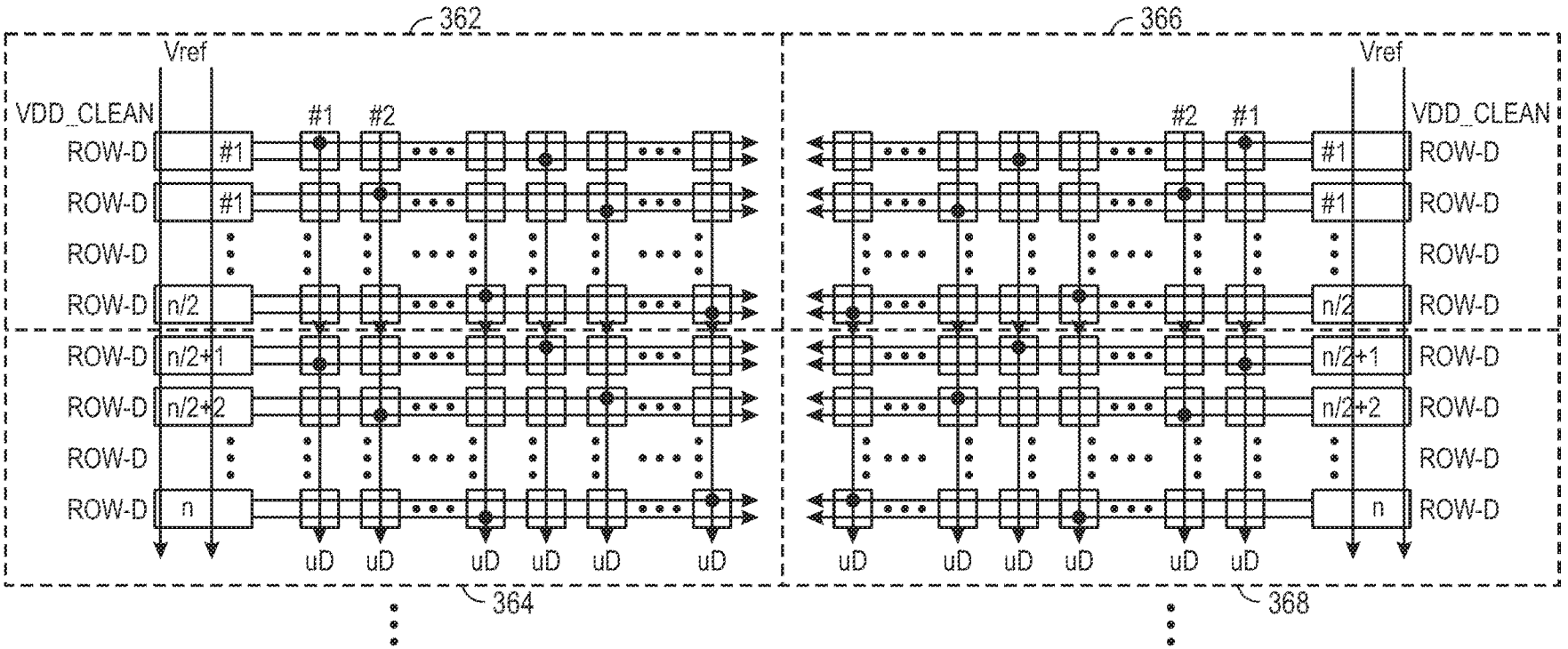
FIG. 15 is a schematic view of a display panel driven using a voltage supplied to row drivers having two output currents, in accordance with an embodiment.

Although the embodiment shown in FIG. 14 has a row driver supplying a current to a single microdriver column in a segment, some row drivers 308 may have more than a single output current. FIG. 15 illustrates a display 360 having two output currents per row driver 308. However, this output current model may be extended to having three, four, or more output currents per row driver. The display 360 is similar to the display 300 of FIG. 14, but the display 360 has smaller segments per row since each row can drive more columns. Specifically, the number of rows in a segment is n/m, where n is the number of columns in segment (e.g., half the number of microdrivers in the display 360) and m is the number of output currents capable of being provided by the row drivers 308. Thus, in the illustrated embodiment, the number of rows in each segment 362, 364, 366, and 368 equals half the number of columns. As the smaller segments include shorter column lengths, the parasitic capacitance is decreased for the display 360.

Figure 16:
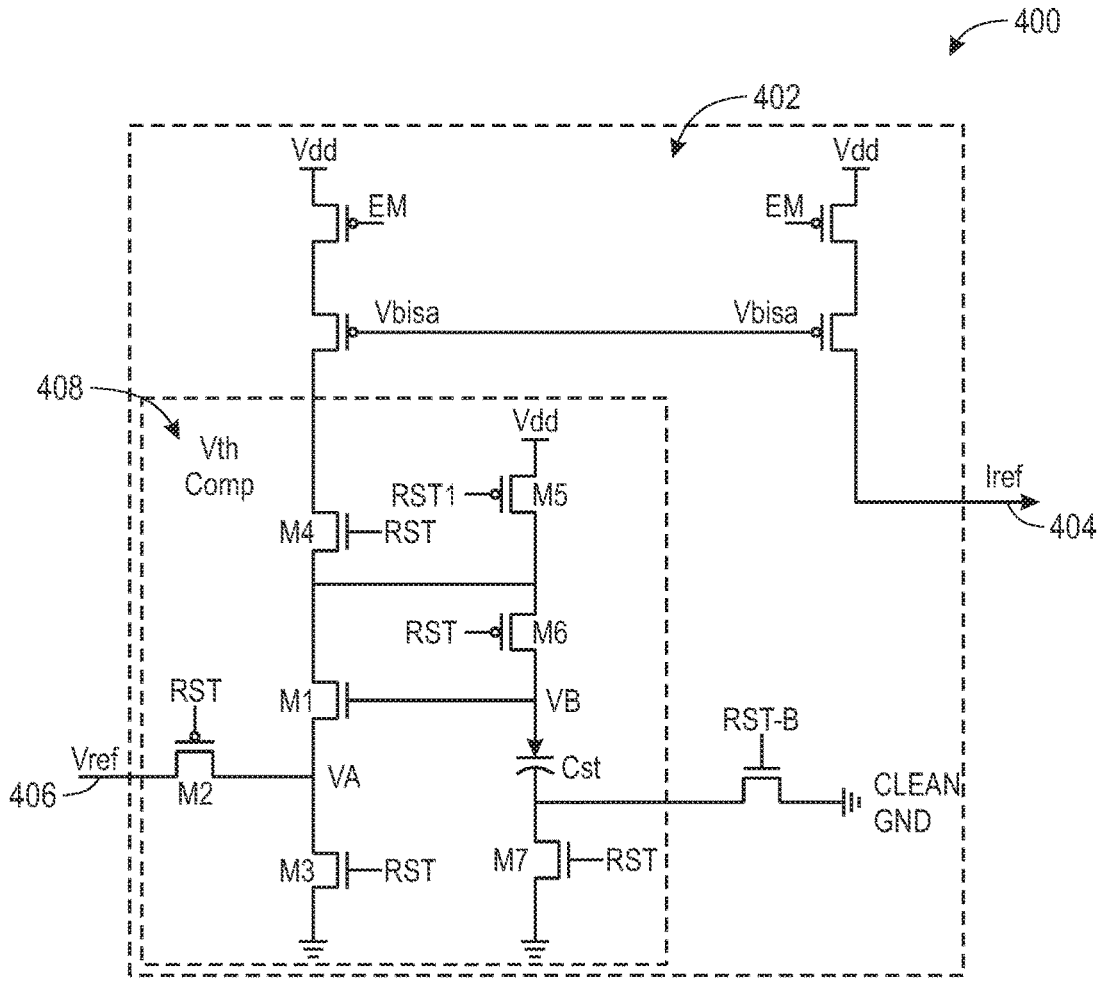
FIG. 16 is a schematic view of a row driver having local current generation using a reference voltage, in accordance with an embodiment.

Since the foregoing discussion contemplates row drivers 308 that receive a reference voltage and generate a reference current, the row drivers 308 include a current generator. FIG. 16 illustrates an embodiment of a current generator 400 that may be employed in the row drivers 308. The current generator 400 includes a current mirror 402 that generates an output current Iref 404 and receives a $V_{ref}$ 406 after it has been submitted to threshold voltage compensation circuitry 408. The threshold voltage compensation circuitry 408 compensates for the threshold voltage used to switch transistors in the current generator 400 and functions similar to the threshold voltage compensation discussed above with regard to the voltage mode. The current generator 400 is voltage based but is independent of supply fluctuations since the supply voltages are used multiple times in the current mirror thereby cancelling out any fluctuation effects on the Iref 404.

Figure 17:
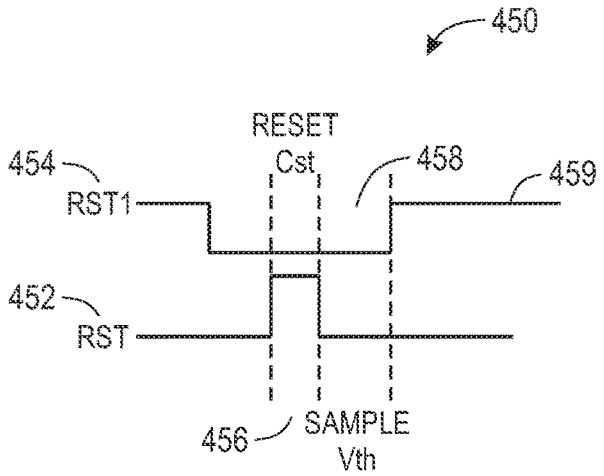
FIG. 17 illustrates a timing diagram for operating the row driver with local current generation, in accordance with an embodiment.

The current generator 400 has three phases: a reset phase, a sample $V_{TH}$ phase, and a compensation phase. FIG. 17 illustrates a timing diagram 450 that may be used to drive the current generator to different phases using an RST 452 and RST1 454. The reset phase 456 begins when RST 452 is set to a logic high causing VB to be equal to $V_{DD}$. The sampling $V_{TH}$ phase 458 begins when RST 452 returns to low thereby causing VB to become $V_{ref}$ plus $V_{TH}$ and VA to be come $V_{ref}$. Once RST1 becomes logic low, the compensation phase 459 begins by using the sampled $V_{TH}$ to drive M1 with compensation for the $V_{TH}$ fluctuations since VB is $V_{TH}$ plus $V_{ref}$. Therefore, Iref 404 is the same as the current through M1 due to the current mirror 402.

Figure 18:
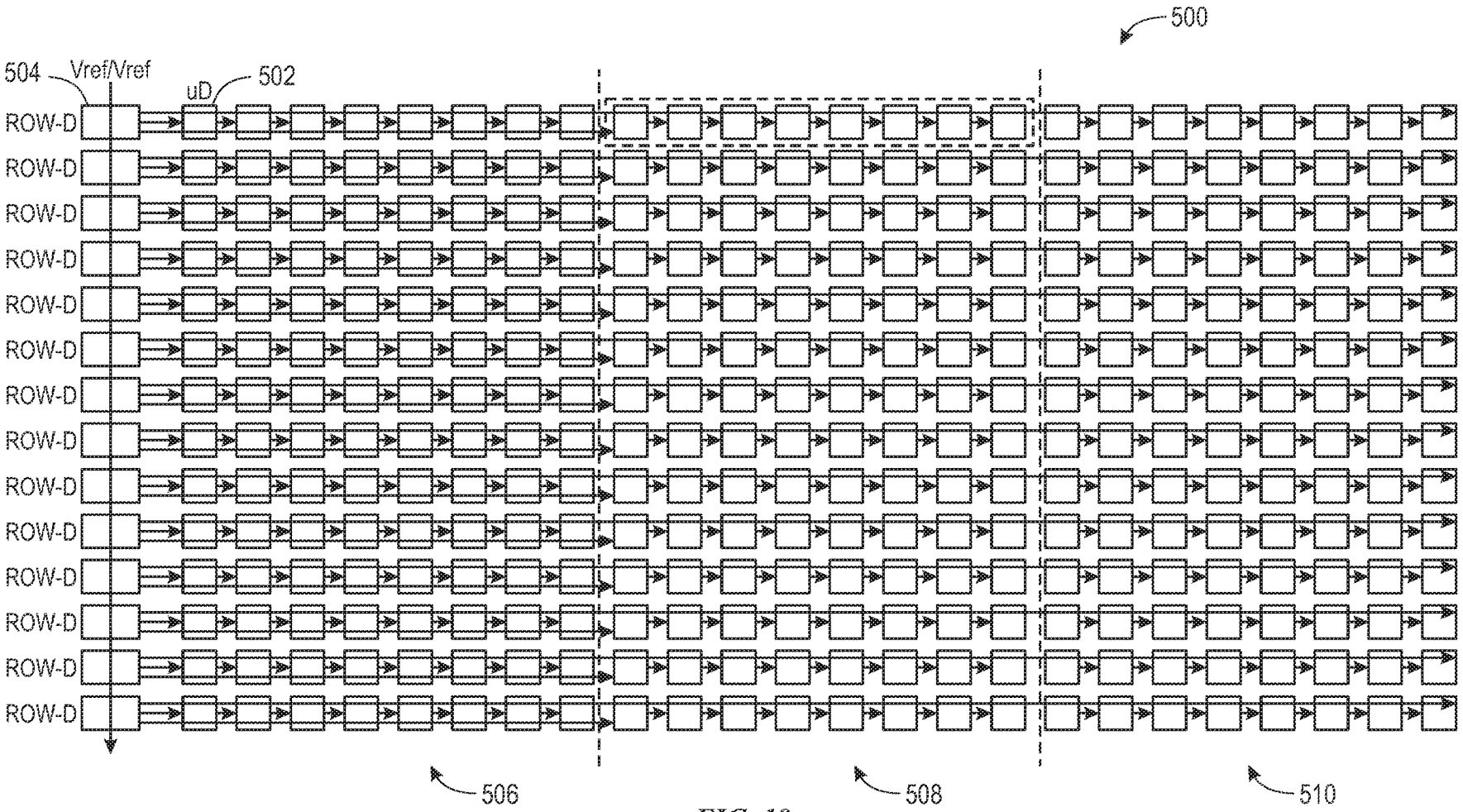
FIG. 18 is a schematic view of a display panel driven using row drivers that provide currents to multiple segments in a row of microdrivers, in accordance with an embodiment.

Although the foregoing discussion discusses that two row drivers may exist per line, some embodiments include row drivers that may drive a whole row while dividing the row horizontally into 1, 2, 3, or more segments. FIG. 18 illustrates a portion of a display 500. The display 500 includes microdrivers 502 distributed in rows and columns throughout the display 500. The microdrivers 502 are driven by row drivers 504. The row drivers 504 are capable to provide one or more currents to the microdrivers 502 in a row. For example, the illustrated embodiment includes 3 output currents from the row driver 504. Thus, the rows of microdrivers are divided in to segments 506, 508, and 510.

As noted above, the current generator 400 may be omitted from the row drivers 308 if the TCON 322 were to provide current sources to the row drivers 308. The trade off for this scheme in simplicity in circuitry of the row drivers 308 is that the current sources would have to be shared with segments in a time-multiplexed fashion. In other words, the segments are no longer independent and requires more stringent timing requirements than the local current generation in the row drivers 308.

Microdrivers

Figure 19:
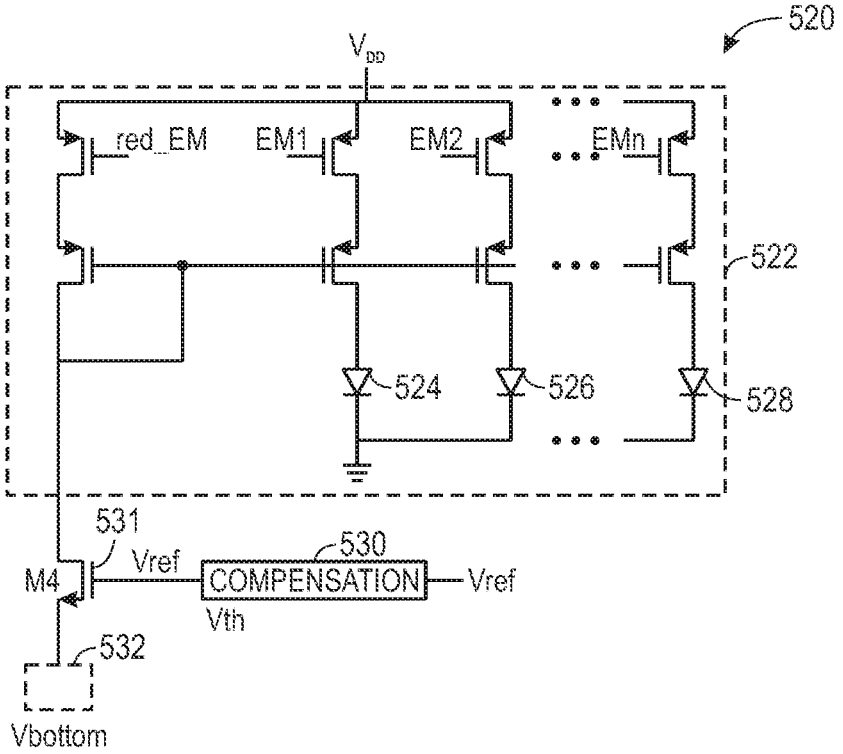
FIG. 19 is a schematic view of a microdriver in voltage mode, in accordance with an embodiment.

As discussed above, the microdrivers receive or generate a reference current for transport to the micropixels that the microdrivers are responsible for driving. FIG. 19 illustrates a voltage drive scheme 520 that includes a selectable current mirror 522 that enables the microdriver to select a micropixel LED that is controlled by the microdriver. For example, the microdriver may select a micropixel 524, 526, or 528 using EM1, EM2, or EMN pulses to create a current mirror feeding the current into the micropixel LEDs.

The voltage drive scheme 520 may also include $V_{TH}$ compensation circuitry 530 that compensations for possible fluctuations of a $V_{TH}$ of a control transistor 531 for the microdriver causing the $V_{TH}$ compensation circuitry 530 to supply $V_{ref}$ plus the $V_{TH}$ for the control transistor 531 to the gate of the control transistor M4. The $V_{TH}$ compensation circuitry 530 may be similar to the foregoing discussed $V_{TH}$ compensation circuits.

The voltage drive scheme 520 also includes a connection to a $V_{bottom}$ 532 that mitigates for IR drop by reducing current further down the display.

Current-Driven Microdrivers

Figure 20:
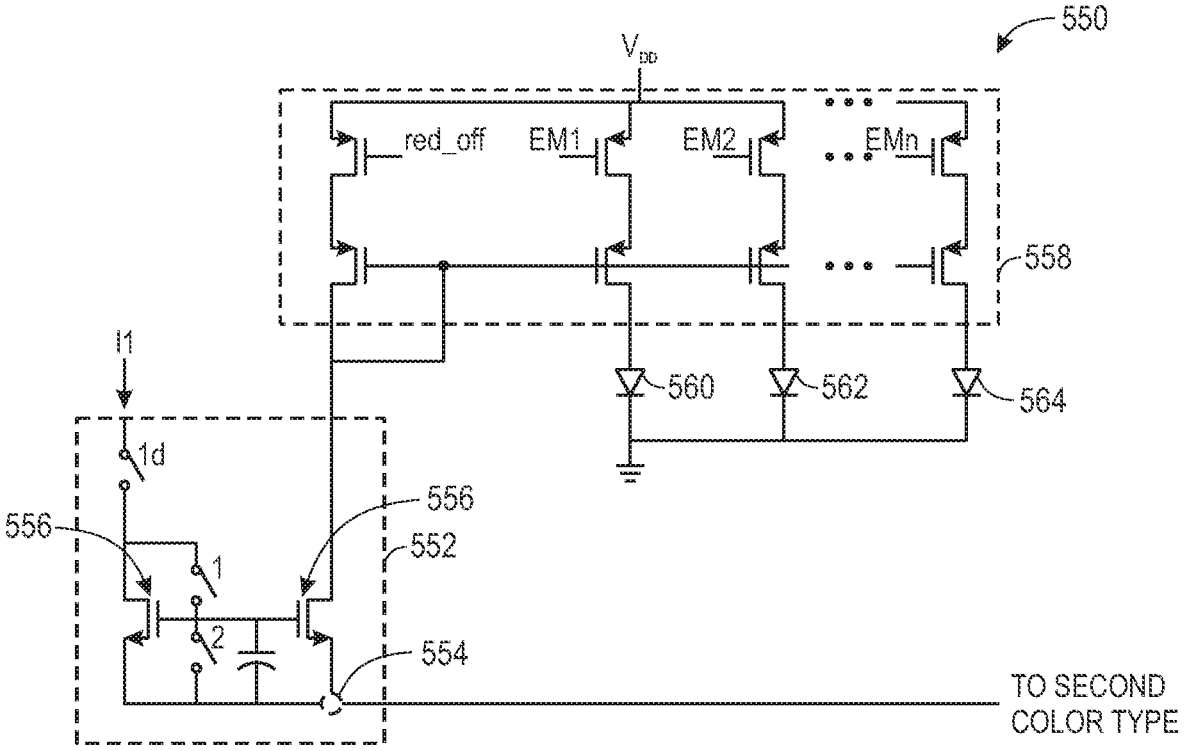
FIG. 20 is a schematic view of a first portion of a microdriver in current mode, in accordance with an embodiment.

FIG. 20 illustrates a current driving scheme 550 for a first portion of a microdriver that receives a first current I1 from a row driver. In some embodiments, the current I1 may be a current line carrying a current to be used for red micropixels driven by the microdriver while one or more other received current lines may be used for blue or green pixels. Moreover, in some embodiments, a single current line may be connected but the red, blue, and green current information may be time multiplexed. As can be understood, electronic circuit behaviors change with temperature. Specifically, $V_{TH}$ and Beta-eff may change with temperature of the transistors (e.g., NMOS and PMOS) in the circuitry. Moreover, even if $V_{TH}$ is compensated using compensation circuitry, Beta-eff will cause the current to change through the transistors. Accordingly, the current driving scheme 550 may include a compensation circuit 552. The compensation circuit 552 reduces or eliminates IR drop issues by using a $V_{bottom}$ voltage, as discussed above, and current driving. Furthermore, the current I1 may be constant to reduce temperature variation. Furthermore, by sampling voltage on the gates of the compensation transistors 556 to reduce or prevent bias change at transistors of a selectable current mirror 558. The selectable current mirror 558 works similar to the previously discussed selectable current mirrors to enable the microdriver to drive micropixels 560, 562, and 564. The microdriver may drive any suitable number of micropixels, such as 1, 2, 3, or more micro pixels.

Figure 21:
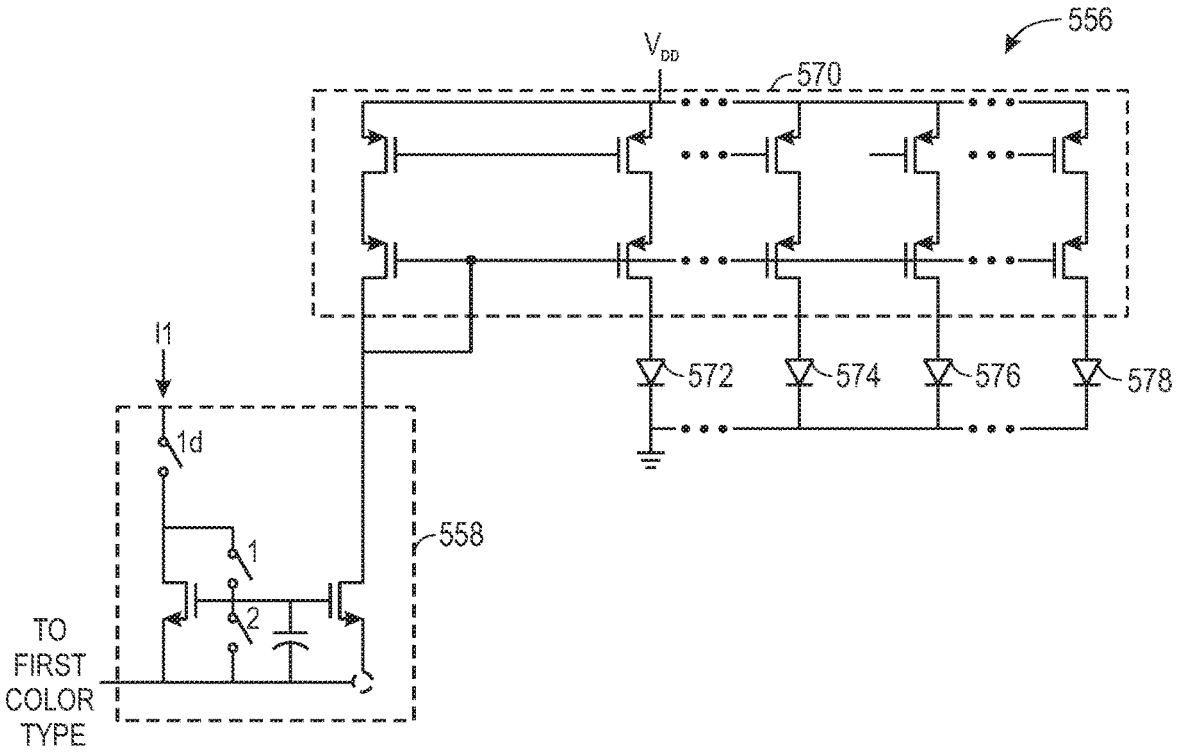
FIG. 21 is a schematic view of a second portion of the microdriver of FIG. 20 in current mode, in accordance with an embodiment.

FIG. 21 illustrates a second portion 566 of the microdriver of FIG. 20. The second portion 566 also includes a compensation circuit 568 that works similar to the compensation circuit 552. However, the second portion 566 (and the related compensation circuit 568) receives an I2 that corresponds to different microdrivers than those driven by the first portion. For example, if the first portion drives red micropixels, the second portion may drive blue and/or green micropixels. The second portion 566 also includes a selectable current mirror 570 that enables the microdriver to drive micropixel LEDs 572, 574, 576, and 578. The micropixels of the second portion 566 may be one or more different colors (e.g., green and blue). For example, micropixel LEDs 572 and 572 and the LEDs therebetween may be green while micropixels LED 576 and 578 and the LEDs therebetween may be blue. The number of micropixels may be equal to the number of micropixels in the first portion or may be double the number of micropixels in the first portion if the second portion drives twice as many colors or may be half if the second portion drives half as many colors. In some embodiments, each portion may drive a single color, and additional portions may be included in the display beyond the portions illustrated in FIGS. 20 and 21.

To drive the micropixels, the bias for the micropixels is changed once every data upload (e.g., every 16 microseconds) with alternation between red and blue-green (or one or more other) bias nodes between consecutive uploads or time-multiplexed within a single data upload. Moreover, a microdriver may drive micropixels in rows above and/or below a location of the microdriver or in columns left and/or right of the microdriver. In other words, the microdriver may drive more than a single row and column of row drivers and the selectable current mirror may be used for all of the connected micropixels. Thus, circuitry may be reused for multiple micropixels increasing area efficiency over dedicated microdrivers restricted to a single row, column, or pixel.

Figure 22:
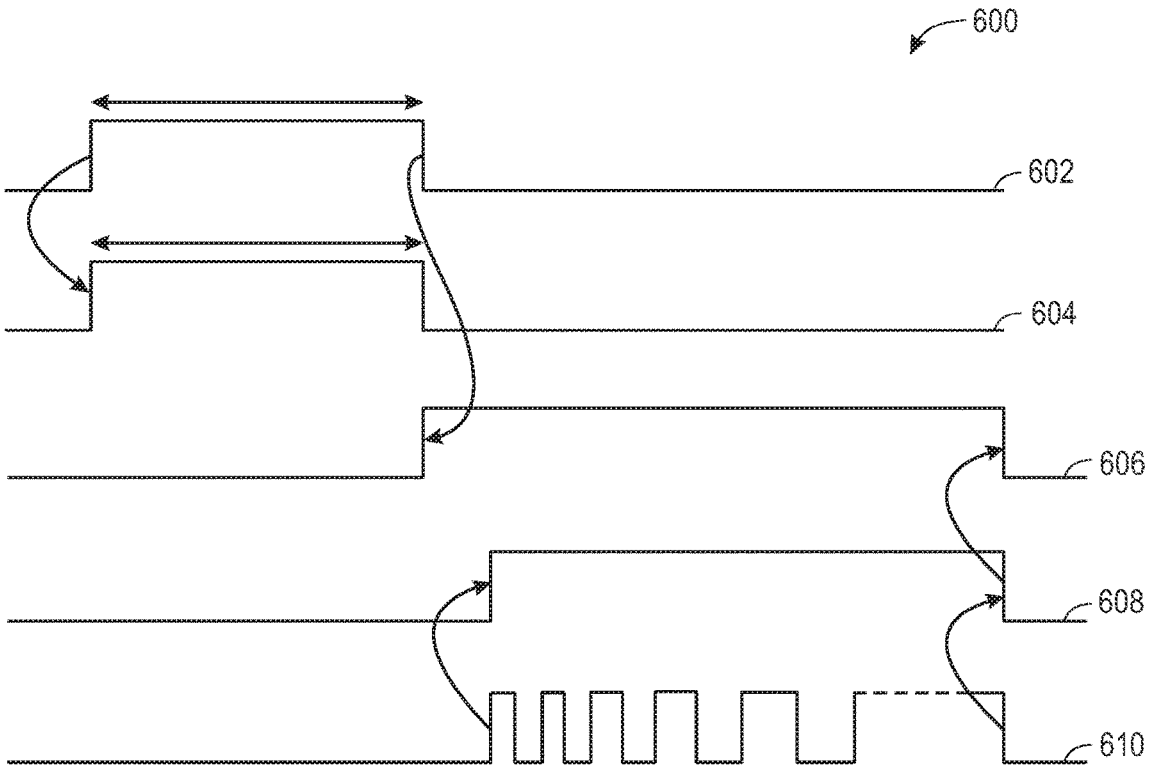
FIG. 22 is a schematic view of a timing diagram for operating a microdriver with a single current sampling during a data upload, in accordance with an embodiment.

FIG. 22 illustrates a timing diagram 600 for a microdriver with two or more different current lines (e.g., one for red and one for blue and/or green or white pixels) or a timing diagram for a microdriver that drives only one pixel type (e.g., red micropixels). The timing diagram 600 includes a data update time interval 602. When the data update clock 602 is high, the current may be sampled. Since the current embodiment includes different current lines, the currents corresponding to the micropixels driven using the current line may be sampled. This sampling is controlled using a current clock 604. Since only a single current is sampled from a data upload, the current may be sampled any time during the data upload. Once the data has been uploaded and the current sampled, the data may be displayed based at least in part on the sampled current when an emission on signal 606 is high. The emission on signal 606 turns on the left side of a selectable current minor. An emission pulse 608 pulses to control whether a specific micropixel is emitting. An emission clock 610 may be used to control pulses such as a pulse width modulation clock for the micropixels when the emission pulse 608 is high.

Figure 23:
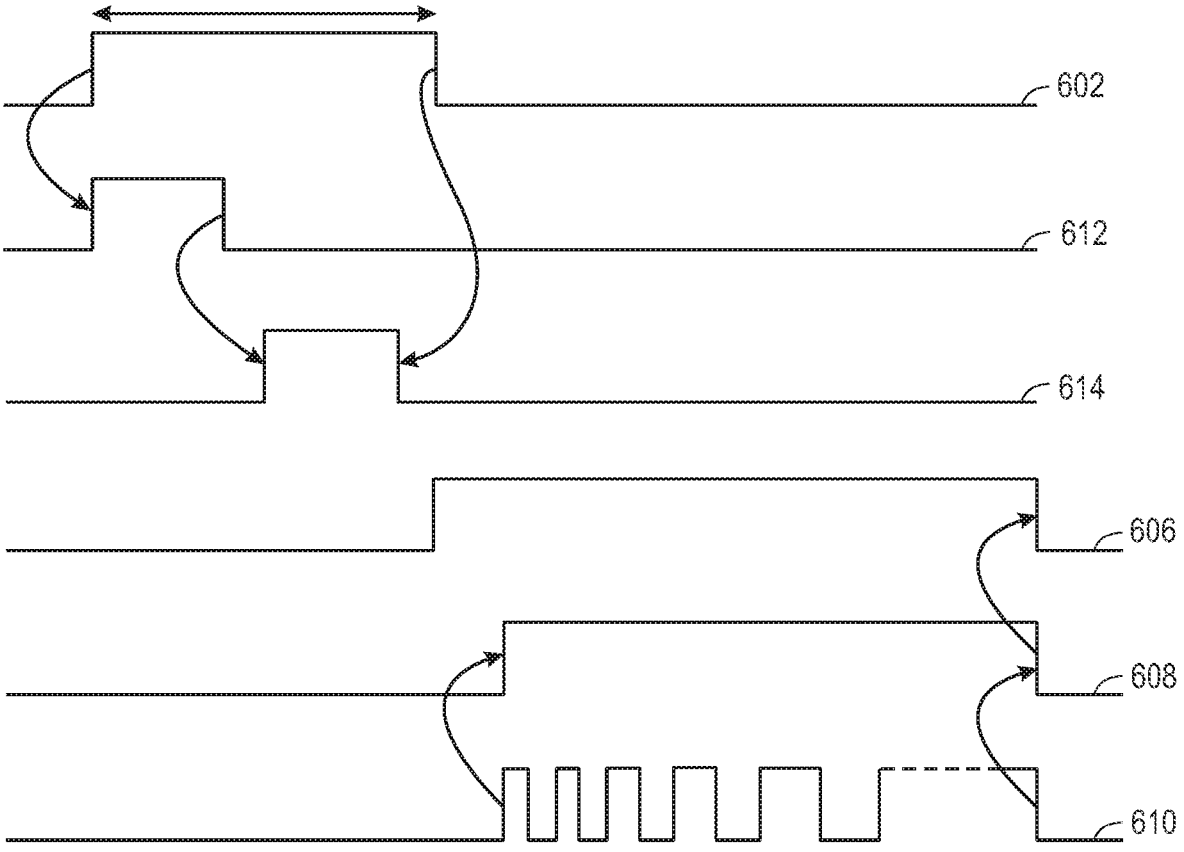
FIG. 23 is a schematic view of a timing diagram for operating a microdriver with multiple current samples time-multiplexed during a data upload, in accordance with an embodiment.

FIG. 23 illustrates a timing diagram with a microdriver that drives multiple pixel types using a single current line. For example, a microdriver may drive red micropixels and blue and/or green micropixels. Thus, sampling of the current line occurs during the data upload clock 602 in a time-multiplexed manner using a first current sampling clock 612 and a second current sampling clock 614 to control when the first and second portions of the microdriver samples the current. Thus, the sampling period is half of the data upload period (e.g., 8 microseconds). Moreover, the microdriver may have more than two portions thereby reducing the sampling period for each type to the data upload period divided by the number of micropixel types.

IR Drop Techniques

The following discussion refers to some additional techniques that may be employed to reduce IR drop and the mura artifacts that result from the IR drop. Some of these additional techniques may be adopted along with some of the foregoing techniques into a single device in any combination.

Figure 24:
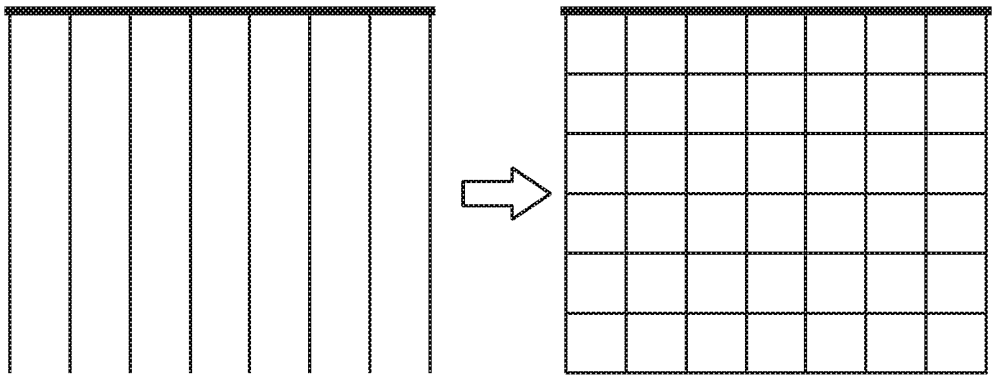
FIG. 24 illustrates a schematic view of replacing power lines with power grids to reduce resistance in IR drop, in accordance with an embodiment.

Current is determined by the display pattern/switching scheme. Once the current (I) is decided, resistance (R) can still be reduced to reduce IR drop. To reduce R, an electronic display may use wider power buses and more vias wherever possible. Given same routing area, different power distribution network can be used. For example, a power stripes formation may be replaced with a power grid as illustrated in FIG. 24. Additionally, reducing R saves power consumption in the display.

Figure 25A:
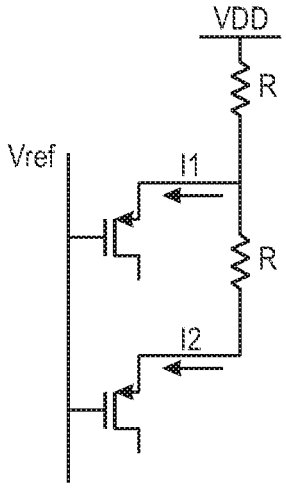
FIG. 25A is a schematic view of a resistance equalization scheme between microdrivers in a display panel, in accordance with an embodiment.
Figure 25B:
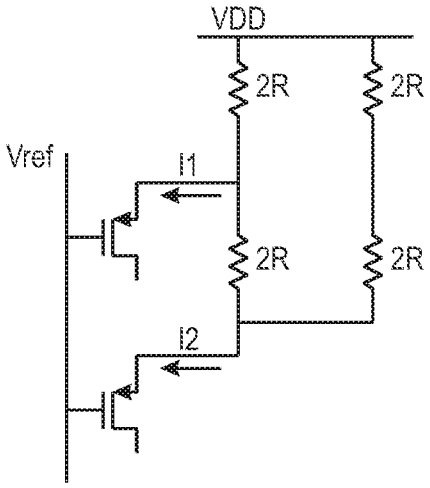
FIG. 25B is a schematic view of another resistance equalization scheme between microdrivers in a display panel, in accordance with an embodiment.

Resistance reduction may also be limited by the routing area available and/or a complexity of the power grid that is feasible for use in the display. When choosing the power distribution network, equalizing the resistance between each pixel to the power supply input point decreases IR drop by ensuring that the resistance between pixels are substantially the same as illustrated in FIGS. 25A and 25B. After equalizing the resistance between current locations, the IR drop of different pixels is just signal dependent and not location dependent. By doing this, IR drop issue is just a gain error and can be easily calibrated.

Figure 26:
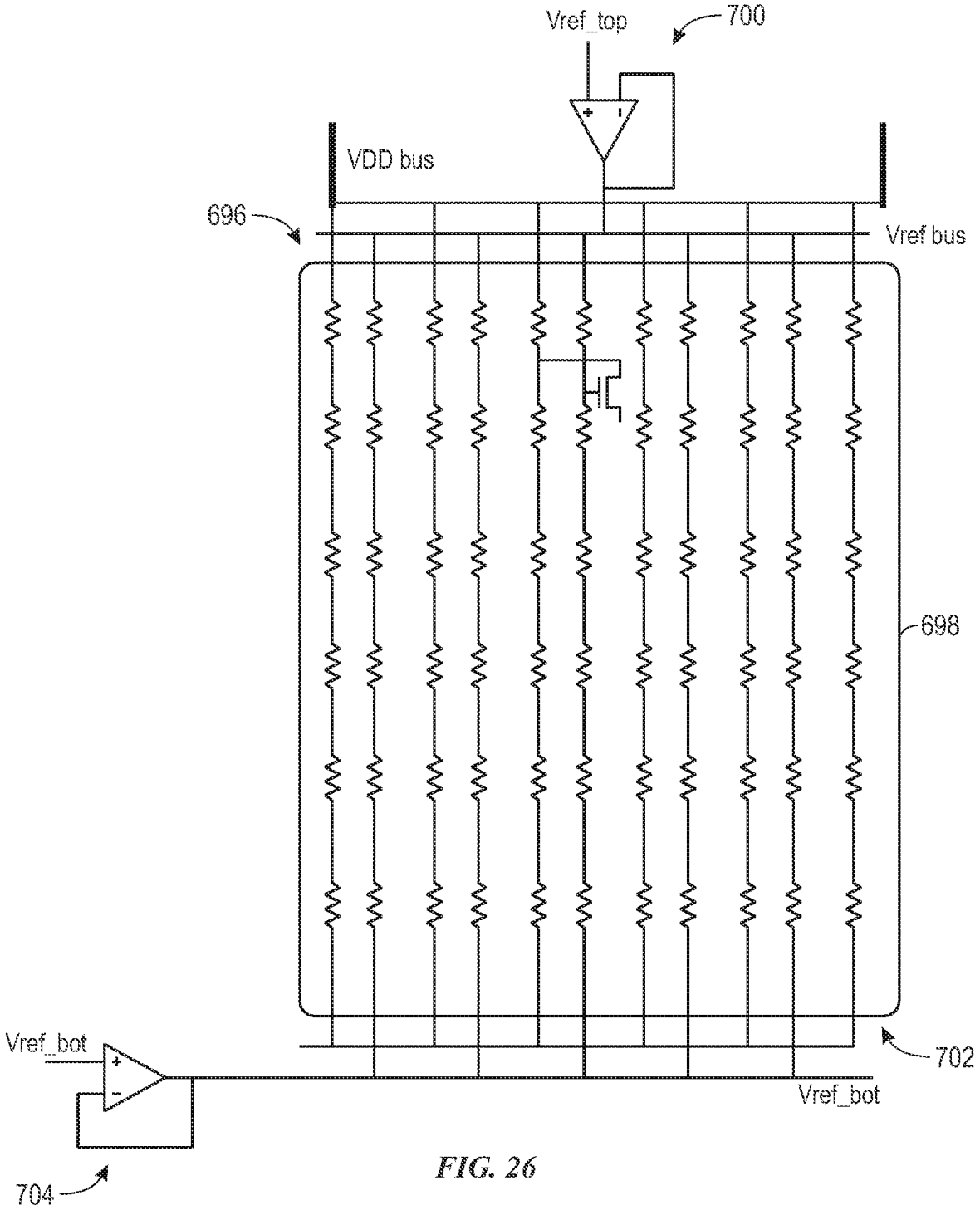
FIG. 26 is a schematic view of IR drop compensation using sampled voltages from a top and bottom of a display panel, in accordance with an embodiment.
Figure 27:
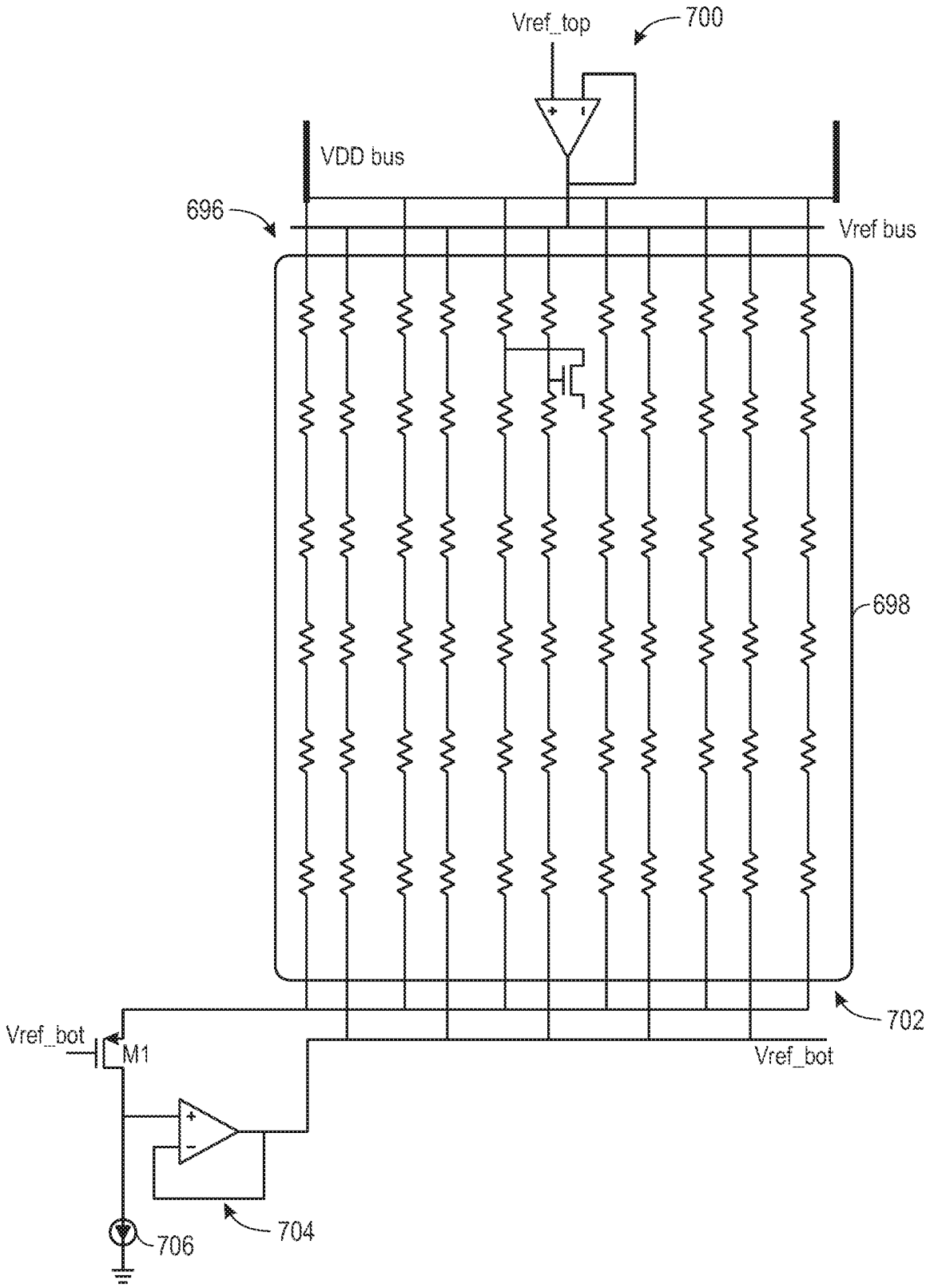
FIG. 27 is a schematic view of IR drop compensation with lookup table (LUT) avoidance, in accordance with an embodiment.

Additionally or alternatively, given that $V_{DD}$ is reduced by the IR drop, the $V_{ref}$ may be manipulated to compensate for the IR drop. For example, as illustrated in FIGS. 26 and 27, sampling $V_{DD}$ at a top 696 of a panel 698 is $V_{DD_top}$ determined using a top sampling circuit 700. Sampling $V_{DD}$ at a bottom 702 of the panel 698 is $V_{DD_bot}$ tom determined using a bottom sampling circuit 704. $V_{ref}$ is then set to be $V_{ref_top}$ at panel top 696 and $V_{ref_bot}$ at the panel bottom 702. When $dV=V_{DD_top}-V_{DD_bot}=V_{ref_top}-V_{ref_bot}$, the first order error from the IR drop can be corrected. To track this information, a lookup table may be used since dV is brightness and pattern dependent.

To avoid the LUT, a diode connected device 706 located at the panel bottom 702 to find out the $V_{ref_bot}$ to be used. Moreover, in some embodiments, M1 may be located inside a row driver. The diode connected device 706 may share its pin with other functions, and be enabled by a configuration bit.

The bias current M1 may be adjusted with different brightness, to have an adaptive control that works for different brightnesses and display patterns.

The device 706 resolves first order IR drop error. To compensation for more pattern-dependent parts of the IR drop, more buffers using the same configuration may be used. A similar device may be in the X dimension as well (in column driver) to compensate for X gradients.

Microdriver Local Sampling

In addition to or alternative to the foregoing implementations for reducing IR drop and threshold voltage and B compensation. Local sampling may be used at each current driver in each microdriver to reduce or eliminate IR drop, eliminate threshold voltage and B mismatch from PMOS output drivers, and eliminate temperature dependence of threshold voltage and B while enabling usage of low-voltage transistor devices as current sources and MOS capacitors. The local sampling may also eliminate cross talk between sub-pixels.

Figure 28:
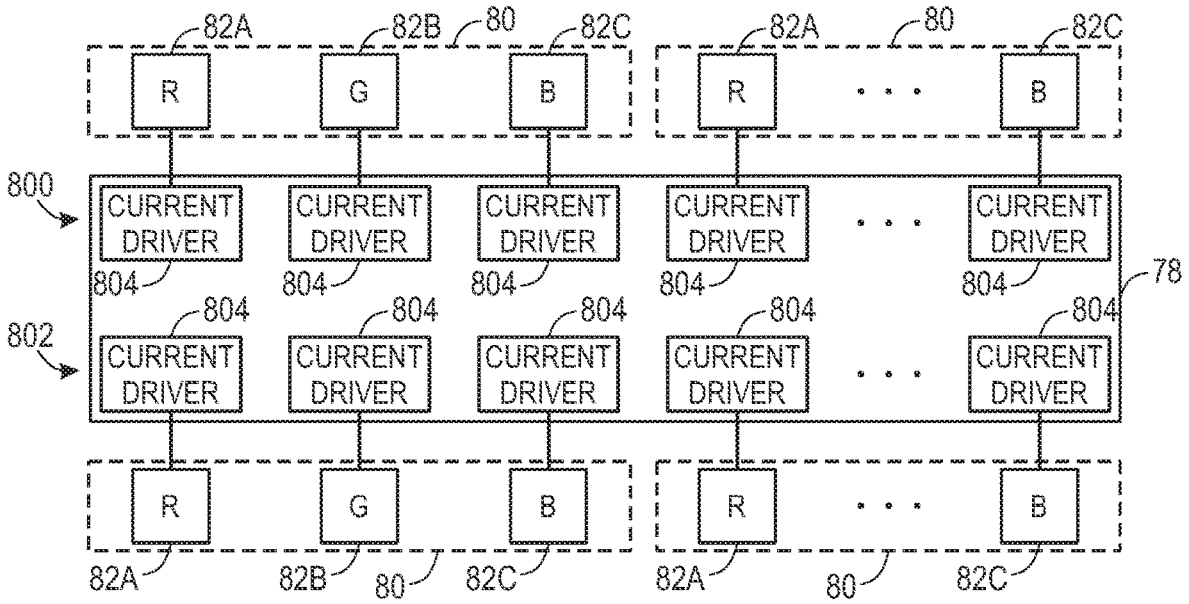
FIG. 28 is a schematic view of a microdriver having multiple current drivers and calibration circuitry, in accordance with an embodiment.

FIG. 28 illustrates a schematic view of a μD 78 that includes two slices 800 and 802 that each drive a row of pixels 80 having micro pixels 82 in each pixel. The micro pixels 82 may include various colors, such as red 82A, green 82B, or blue 82C. The first slice 800 may correspond to a row of primary pixels 80, and the second slice 802 may correspond to a row of redundant pixels 80 that each may be used as a backup to a corresponding pixel 80 of the primary pixels 80. Alternatively, the first slice 800 and the second slice 802 may be used to emit during a single frame in conjunction.

The first slice 800 includes multiple current drivers 804 that each drives a micropixel 82 in the first row. The number of current drivers 804 corresponds to the number of micropixels 82 in the first row. The second slice 802 includes multiple current drivers 806 that each drives a micropixel 82 in the second row using to a specific current. In some embodiments, the number of current drivers 806 and micropixels 82 in a slice may be 3, 6, 9, 12, 15, or more. In some embodiments, each slice includes a multiple of a number (e.g., 3) of colors of micropixels 82 included in a pixel 80. In some embodiments, some colors may be omitted from some pixels 80 but included in other pixels 80 causing a slice to include any number of micropixels 82 and/or current drivers 806. As is discussed below, each current driver 804 drives a respective LED of a micropixel 82 to a predetermined level in a manner that is robustly resistant to temperature variation effects on transistor characteristics, such as threshold voltage and/or B. Specifically, as discussed below, current calibration circuitry 810 generates a calibration current that is provided to a calibration portion of each current driver 804, 806 for use in ensuring that a predetermined current is used to power an LED regardless of temperature variations and resultant transistor characteristics of a transistor that controls access to the LED.

Figure 29:
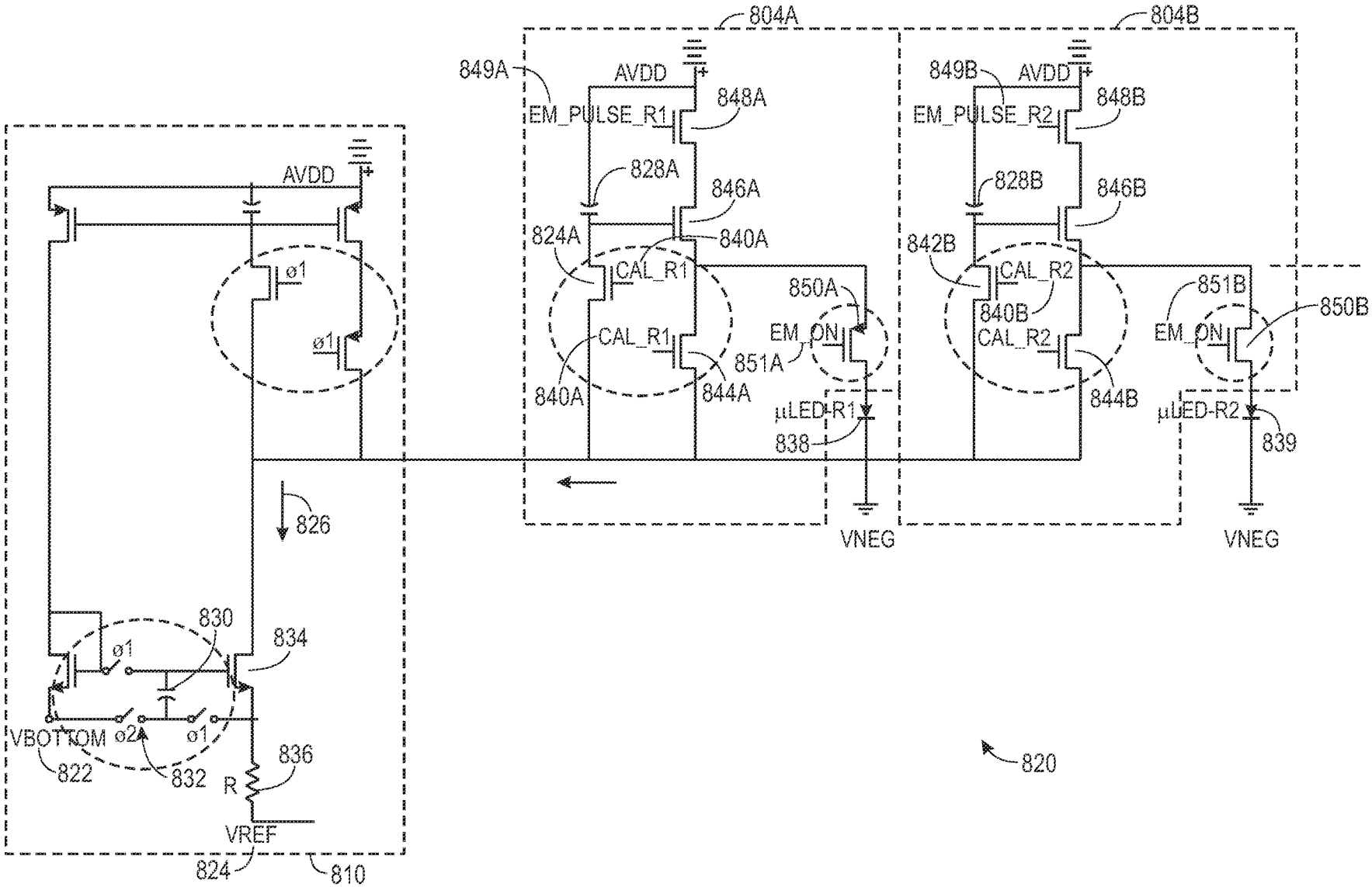
FIG. 29 is a schematic view of the current driver and the calibration circuitry of FIG. 28, in accordance with an embodiment.

FIG. 29 illustrates a schematic view of an embodiment of circuitry 820 of a μD 78 that includes the current drivers 804 and calibration circuitry 810. The calibration circuitry 810 uses $V_{bottom}$ 822 and $V_{ref}$ 824 to generate a calibration current 826 that is used to charge calibration capacitors 828 of each current driver 804 sequentially. The calibration circuitry 810 may also include a $V_{ref}$ capacitor 830 that may be charged with the $V_{ref}$ 824 using a switch network 832 that may disconnect the $V_{ref}$ capacitor 830 once the $V_{ref}$ capacitor 830 is charged. Using the $V_{ref}$ capacitor 830 to store the $V_{ref}$ 824 for application to the gate of transistor 834 that controls whether the calibration current 826 exists. Furthermore, the calibration circuitry 810 includes a resistor 836 that controls the level of current along with the $V_{bottom}$ 822 and $V_{ref}$ 824. Specifically, the calibration current 826 may be determined using the following equation:

$$I_{cal} = \frac{V_{bottom} - V_{ref}}{R} \quad \text{(Equation 1)}$$

where $I_{cal}$ is the calibration current 826 and R is the resistance of the resistor 836.

The calibration current 826 is used to sequentially charge current driver 804. The calibration mode for each current driver 804 may be set using a calibration signal. For example, the current driver 804A that corresponds to an LED 838 is driven to a calibration mode by a calibration signal 840A, and the current driver 804B that corresponds to an LED 839. The calibration signals 840 cause respective transistors 842 and 844 to enable current to travel through the respective transistors 842 and 844 to charge a respective calibration capacitor 828. Once the calibration capacitor 828 is charged for a current driver 804, the current driver 804 may be taken out of calibration mode by deasserting the respective calibration signal 840. During an emission mode, the calibration capacitor 828 provides a voltage the causes a specific current to pass through a transistor 846 during emission. Furthermore, by using the capacitor to supply the gate voltage to the transistor 846, the voltage may be supplied when the capacitor is disconnected from the calibration current 826 when the transistors 842 and 844 shut off connection due to deassertion of the calibration signal for the current driver 804. An emission transistor 848 controls whether a respective current driver is emitting in an emission mode based on a pulse signal 849. The pulse signal 849 may be a pulse width modulated (PWM) signal that controls a level of luminance of the respective LED (e.g., LED 838). Each current driver 804 may also include an emission transistor 850 that controls whether the current driver 804 is in an emission mode. Essentially, the transistor 850 may have a first mode (e.g., transmissive) during an emission mode and a and a second mode (e.g., non-transmissive) during the calibration mode. In some embodiments, the PWM driving scheme to modulate luminance of the respective LED in addition to or in place of the PWM driving scheme applied to the transistor 848.

Figure 30:
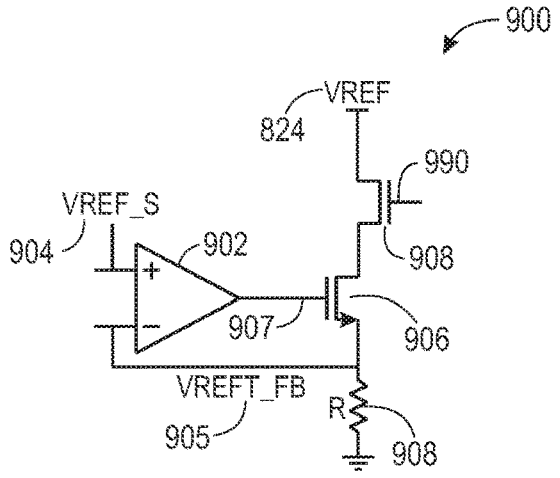
FIG. 30 is a schematic view of an operational amplifier circuit for providing a reference voltage to calibration circuitry of FIG. 28, in accordance with an embodiment.

In some embodiments, the supplied voltages (e.g., $V_{bottom}$ 822, $V_{ref}$ 824, a $V_{DD}$, etc.) may be supplied using operational amplifiers. FIG. 30 illustrates a $V_{ref}$ circuit 900 used to supply the $V_{ref}$ 824 to the calibration circuitry 810. The $V_{ref}$ circuit 900 includes an operational amplifier 902 that receives a supplied $V_{ref_s}$ 904 voltage at its non-inverting input terminal and a feedback $V_{ref_fb}$ 905. The circuit is substantially a unity gain with an emitter follower implemented using transistor 906 connected to the operational amplifier 902. Essentially, this arrangement increases a current sourcing capability of the operational amplifier. In other words, the $V_{ref_s}$ 904 and the $V_{ref_fb}$ 905 are substantially similar as the gate-source voltage (VGS) of transistor 906 since the unity gain arrangement of the circuit 900 causes $V_{ref_s}$ 904 to be equal to $V_{ref_s}$ 907. A resistor 908 controls a current through the circuit and transistor 906 controls whether the circuit 900 is providing the $V_{ref}$ 824 to the calibration circuitry 810 based at least in part on a supply signal 910.

Figure 31:
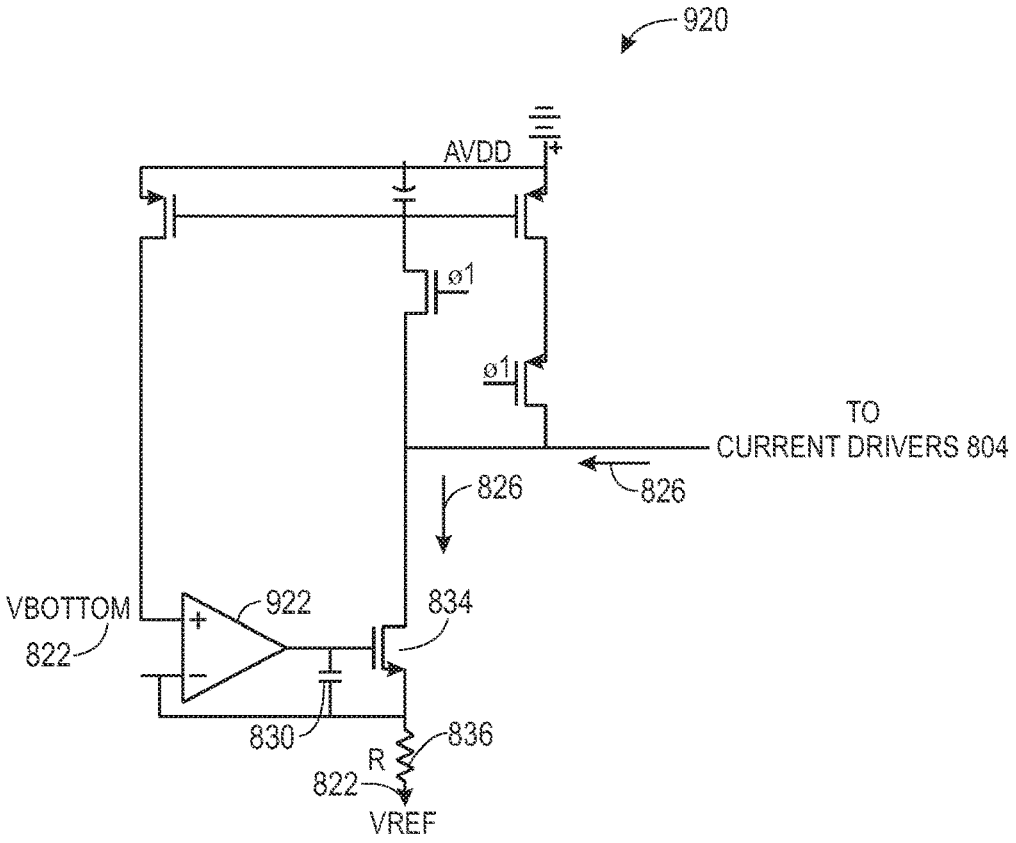
FIG. 31 is a schematic view of the calibration circuitry if FIG. 28 including an operational amplifier, in accordance with an embodiment.

FIG. 31 illustrates an embodiment of a calibration circuit 920 that may be similar to the calibration circuitry 810 of FIG. 29 except the calibration circuit 920 uses an operational amplifier 922 to supply $V_{bottom}$ 822 to the transistor 834.

Figure 32:
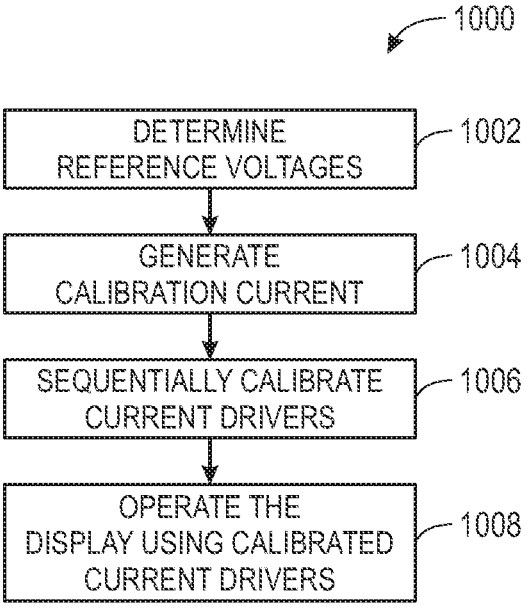
FIG. 32 is a flow diagram view of a process for operating a display using calibrated current drivers, in accordance with an embodiment.

FIG. 32 illustrates a process 1000 for operating a display by calibrating current drivers. The process begins by determining reference voltages (block 1002). For example, $V_{bottom}$ 822 and/or $V_{ref}$ 824 may be adjusted based at least in part on temperature variation of the resistor 836 and/or the transistor 834. In some embodiments, one voltage (e.g., $V_{ref}$ 824) may be adjusted while the other is kept constant.

Using the reference voltages, the calibration circuitry 810 generates a calibration current 826 (block 1004). The calibration current is generated across the resistor 836. In some embodiments, the reference voltages are used to generate the calibration current 826 with at least one of the reference voltages captured in a capacitor (e.g., capacitor 830). Once the calibration current 826 is generated, the calibration circuitry 810 provides the calibration current 826 appropriate current drivers 804 in the μD 78 (block 1006). Specifically, the calibration current 826 is connected to calibration capacitors 828 using calibration transistors 842 and 844 sequentially. A PWM transistor 848 is also connected. Using these connections, a capacitor 828 is charged such that an output voltage is placed at the gate of a current driver transistor 846 to produce an output current to an LED that is substantially independent of transistor parameter changes of the transistor 846 based at least in part on temperature. In other words, the gate voltage, stored in the capacitor 828, accounts for variations in the current driver transistor and/or variations in the power supply (e.g., a $V_{DD}$). Using the gate voltage, each current driver is used to operate the display using a gate voltage that is substantially independent of variations to the transistor and/or the power supply (block 1008).

It should be noted that more than a single calibration current may be used. For example, the calibration current may be specific to a particular color. In other words, in a RGB display, a calibration current for red current drivers may differ from a calibration current for blue or green current drivers. In some embodiments, red current drivers may have their own calibration current while blue and green current drivers share a calibration current. Alternatively, red, green, and blue current drivers may have their own calibration current specific to a respective color.

The calibration scheme may performed multiple times per frame. For example, a first calibration process for a first portion (e.g., first group of μDs and/or first group of rows) and a second calibration process for a second portion of the display. Furthermore, since voltage in the capacitor 828 may gradually decrease over time due to leakage, increasing frequency of calibrations may improve maintenance of a constant calibration current via a constant voltage stored in the capacitor.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure. Moreover, although the foregoing discusses row drivers that send data to μD s and column drivers that send data to microdrivers and row drivers that control which μD in a row receives the data, it should be appreciated that the foregoing discussion about row drivers may be applied to column drivers and vice versa merely by rotating orientation of the display. Thus, recitations of columns and rows may be interchangeable in meaning herein.

What is claimed is:

1. An electronic device comprising:

a plurality of row drivers configured to receive an electrical charge;

a plurality of microdrivers, wherein at least one microdriver of the plurality of microdrivers is configured to receive a reference current from at least one of the plurality of row drivers, wherein the reference current is based at least in part on electrical charge, wherein the at least one of the plurality of row drivers is configured to ship the reference current through the at least one microdriver through a row of the plurality of microdrivers to at least two microdrivers in a column of microdrivers of the plurality of microdrivers, wherein the column is orthogonally arranged respective to the row, wherein each of the at least two microdrivers are configured to drive a plurality of micropixels corresponding to a respective microdriver of the column using the shipped reference current; and the plurality of micropixels configured to emit light in a pattern based at least in part on the reference current received from the plurality of microdrivers.

2. The electronic device of claim 1 comprising at least one timing controller that ships the electrical charge to the plurality of row drivers.

3. The electronic device of claim 1, wherein the plurality of row drivers comprises:

a first column of row drivers located at a first edge of a display panel; and a second column of row drivers located at a second edge of the display panel, wherein the first and second edges are located on opposing ends of the display panel.

4. The electronic device of claim 1, wherein a microdriver of the plurality of microdrivers comprises a compensation circuit that compensates for temperature fluctuations that affect electrical properties in the microdriver.

5. The electronic device of claim 1, wherein each row driver of the plurality of row drivers is configured to drive a row of micropixels.

6. An electronic device comprising:

a plurality of row drivers configured to:

receive a reference voltage; and generate a reference current based at least in part on the received reference voltage;

a plurality of microdrivers configured to receive the reference current from the plurality of row drivers, wherein at least one of the plurality of row drivers is configured to ship the reference current through at least one microdriver through a row of the plurality of microdrivers to at least two microdrivers in a column of microdrivers of the plurality of microdrivers, wherein the column is orthogonally arranged respective to the row, wherein each of the at least two microdrivers are configured to drive a plurality of micropixels corresponding to a respective microdriver of the column using the shipped reference current; and the plurality of micropixels configured to emit light in a pattern based at least in part on the reference current received from the plurality of microdrivers.

7. The electronic device of claim 6, wherein the plurality of microdrivers are divided into a plurality of segments.

8. The electronic device of claim 7, wherein the plurality of segments horizontally divides rows of microdrivers into a first segment and a second segment, and the plurality of row drivers comprises:

a first column of row drivers configured to drive microdrivers in the first segment; and a second column of row drivers configured to drive microdrivers in the second segment.

9. The electronic device of claim 8, wherein the first and second columns are located at opposite ends of a display panel.

10. The electronic device of claim 7, wherein the plurality of segments horizontally divide rows of microdrivers into a first segment and a second segment, and a row driver is configured to drive microdrivers in the first segment using a first current line and to drive microdrivers in the second segment using a second current line.

11. The electronic device of claim 7, wherein each row driver is configured to drive a portion of a column of the plurality of microdrivers located in a segment of the plurality of segments.

12. The electronic device of claim 7, wherein each segment of the plurality of segments comprises a number of rows of microdrivers in the segment proportional to a number of columns of microdrivers in the segment.

13. The electronic device of claim 12, wherein the proportion is one-to-one.

14. The electronic device of claim 12, wherein the proportion is one divided by a number of current lines from each of the plurality of row drivers.

15. The electronic device of claim 6, wherein each microdriver comprises a selectable current mirror configured to enable selection of a specific micropixel of the plurality of micropixels coupled to the microdriver to drive the specific micropixel.

16. A method for driving a display panel comprising:

receiving a reference voltage at a row driver;

locally generating a reference current in the row driver based at least in part on the reference voltage; and shipping the reference current to a microdriver for driving micropixels, wherein the row driver is configured to ship the reference current through the microdriver through a row of a plurality of microdrivers to at least two microdrivers in a column of microdrivers, wherein the column of microdrivers are orthogonally arranged respective to the row, wherein each of the at least two microdrivers are configured to drive a plurality of micropixels using the shipped reference current.

17. The method of claim 16, wherein receiving the reference voltage comprises receiving the reference voltage from a timing controller.

18. The method of claim 16 comprising driving the micropixels, using the microdriver, based at least in part on the reference current.

19. An electronic device comprising:

a plurality of row drivers configured to receive a reference voltage;

a plurality of microdrivers coupled to the plurality of row drivers and configured to receive electrical charge from the plurality of row drivers, wherein the electrical charge is based at least in part on the reference voltage, wherein at least one of the plurality of row drivers is configured to ship the reference current through at least one microdriver through a row of the plurality of microdrivers to at least two microdrivers in a column of microdrivers of the plurality of microdrivers, wherein the column is orthogonally arranged respective to the row, wherein each of the at least two microdrivers are configured to drive a plurality of micropixels corresponding to a respective microdriver of the column using the shipped reference current; and the plurality of micropixels configured to receive the electrical charge from the plurality of microdrivers and to emit light in a pattern based at least in part on the electrical charge received from the plurality of microdrivers.

20. The electronic device of claim 19, wherein the plurality of microdrivers each comprises compensation circuitry that compensates for electrical property variations of the electronic device.

21. The electronic device of claim 20, wherein the electrical property variations comprise variations that are based on temperature.

22. An electronic device comprising:

a plurality of column drivers configured to:

receive a reference voltage; and generate a reference current based at least in part on the received reference voltage;

a plurality of microdrivers configured to receive the reference current from the plurality of column drivers, wherein at least one of the plurality of column drivers is configured to ship the reference current through at least one microdriver through a column of the plurality of microdrivers to at least two microdrivers in a row of microdrivers of the plurality of microdrivers, wherein the column is orthogonally arranged respective to the row, wherein each of the at least two microdrivers are configured to drive a plurality of micropixels corresponding to a respective microdriver of the row using the shipped reference current; and the plurality of micropixels configured to emit light in a pattern based at least in part on the reference current received from the plurality of microdrivers.

23. The electronic device of claim 1, wherein the plurality of micropixels is distributed between opposite sides of a respective microdriver of the plurality of microdrivers.

* * * * *